US012152359B2

(12) United States Patent
Vickers

(10) Patent No.: US 12,152,359 B2
(45) **Date of Patent: *Nov. 26, 2024**

(54) CONTAINMENT DIKE

(71) Applicant: P.V. Flood Control Corp., Calgary (CA)

(72) Inventor: Paul Vickers, Calgary (CA)

(73) Assignee: P.V. Flood Control Corp., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/223,182

(22) Filed: Jul. 18, 2023

(65) Prior Publication Data

US 2023/0358005 A1 Nov. 9, 2023

Related U.S. Application Data

(63) Continuation of application No. 17/832,435, filed on Jun. 3, 2022, now Pat. No. 11,746,488, which is a continuation of application No. 16/784,059, filed on Feb. 6, 2020, now Pat. No. 11,384,497, which is a continuation of application No. 16/442,332, filed on Jun. 14, 2019, now Pat. No. 10,584,454, which is a continuation of application No. 15/368,363, filed on Dec. 2, 2016, now Pat. No. 10,378,168, which is a (Continued)

(51) Int. Cl.
*E02B 3/10* (2006.01)

(52) U.S. Cl.
CPC ..... *E02B 3/108* (2013.01); *E02B 3/10* (2013.01); *E02B 3/106* (2013.01)

(58) Field of Classification Search
CPC ..... E02B 3/108; E02B 3/10; E02B 3/106
See application file for complete search history.

(56) References Cited

U.S. PATENT DOCUMENTS 4,158,896 A 6/1979 Farkas
4,921,373 A 5/1990 Coffey (Continued)

FOREIGN PATENT DOCUMENTS

CN 203546671 U 4/2014
CN 204039975 U 12/2014

(Continued)

OTHER PUBLICATIONS

Chinese First Office Action, Chinese Application No. 2016800081542, Jun. 1, 2018, 10 pages.

(Continued)

*Primary Examiner* — Kyle Armstrong
(74) *Attorney, Agent, or Firm* — Fenwick & West LLP

(57) ABSTRACT

Flexible containment tubes form sections of a dike for fluid containment. For example, multiple vinyl-coated polyester tubes with a 19-inch diameter may be filled with water and stacked on top of each other to create a temporary diversion dike. Multiple sections of dike may be abutted together to form longer sections of dike. A vapor barrier or plastic membrane may wrap over dike sections and/or weaved through the flexible containment tubes as they are placed prior to filling. Configurations of the vapor barrier and associated anchoring mechanisms improve the utility of dike sections by reducing hydrostatic pressure of contained fluid on the dike, harnessing the weight of fluid columns, and mitigating seepage through the dike sections.

12 Claims, 18 Drawing Sheets

Related U.S. Application Data continuation of application No. 15/141,267, filed on Apr. 28, 2016, now Pat. No. 9,528,236.

(60) Provisional application No. 62/155,269, filed on Apr. 30, 2015.

(56) References Cited

U.S. PATENT DOCUMENTS

| | | | |
|---|---|---|---|
| 5,040,919 | A | 8/1991 | Hendrix |
| 5,125,767 | A | 6/1992 | Dooleage |
| 5,605,416 | A | 2/1997 | Roach |
| 5,669,732 | A | 9/1997 | Truitt |
| 5,865,564 | A | 2/1999 | Miller et al. |
| 5,971,661 | A | 10/1999 | Johnson et al. |
| 6,334,736 | B1 | 1/2002 | Johnson et al. |
| 6,491,431 | B2 | 12/2002 | Merten |
| 6,641,329 | B1 | 11/2003 | Clement |
| 7,357,598 | B1 | 4/2008 | Bradley |
| 7,762,742 | B1 | 7/2010 | Smith |
| 9,528,236 | B2 | 12/2016 | Vickers |
| 9,562,335 | B1 | 2/2017 | Arrington |
| 9,562,350 | B1 | 2/2017 | Witt |
| 10,472,786 | B2 | 11/2019 | Vickers |
| 2004/0010601 | A1 | 1/2004 | Afergan et al. |
| 2005/0260038 | A1 | 11/2005 | Sousa Costa |
| 2008/0193229 | A1 | 8/2008 | Graham et al. |
| 2008/0253838 | A1 | 10/2008 | Salemie |
| 2009/0274519 | A1 | 11/2009 | Shaw |
| 2013/0108372 | A1 | 5/2013 | Abeles |
| 2014/0010601 | A1 | 1/2014 | Bradley, Sr. et al. |
| 2014/0117012 | A1 | 5/2014 | Waid |
| 2015/0240436 | A1 | 8/2015 | Miller |

FOREIGN PATENT DOCUMENTS

| | | | |
|---|---|---|---|
| CN | 204080734 | U | 1/2015 |
| CN | 107208390 | A | 9/2017 |
| DE | 102008030984 | A1 | 12/2009 |
| DE | 202014009564 | U1 | 2/2015 |
| EP | 1892335 | A2 | 2/2008 |
| JP | S3714258 | Y | 6/1962 |
| JP | H074120 | A | 1/1995 |
| JP | H11501092 | A | 1/1999 |
| JP | H11323936 | A | 11/1999 |
| JP | 2000226824 | A | 8/2000 |
| JP | 2003074037 | A | 3/2003 |
| JP | 2006-045772 | A | 2/2006 |
| JP | 2008045772 | A | 2/2008 |
| JP | 2009019480 | A | 1/2009 |
| JP | 2015121048 | A | 7/2015 |
| JP | 2018504540 | A | 2/2018 |
| KR | 10-0778321 | B1 | 11/2007 |
| WO | WO 99/41459 | A1 | 8/1999 |
| WO | WO 2001/11148 | A1 | 2/2001 |
| WO | WO 02/40780 | A1 | 5/2002 |
| WO | WO 2006/114547 | | 11/2006 |
| WO | WO 2015/002536 | A1 | 1/2015 |
| WO | WO 2016/176489 | A1 | 11/2016 |

OTHER PUBLICATIONS

European Patent Office, Examination Report, European Patent Application No. 19747569.2, May 27, 2022, 10 pages.

European Patent Office, Extended European Search Report and Opinion, EP Patent Application No. 19747569.2, Sep. 30, 2021, 9 pages.

European Extended Search Report, European U.S. Appl. No. 16/787,177 .1, Feb. 22, 2018, 8 pages.

Japan Patent Office, Office Action, JP Patent Application No. 2022-116394, Feb. 14, 2023, 8 pages.

Japan Patent Office, Office Action, JP Patent Application No. 2020-541672, Dec. 8, 2020, 4 pages.

Japan Patent Office, Office Action, JP Patent Application No. 2018-128373, Apr. 28, 2020, 6 pages.

Japanese Office Action, Japanese Application No. 2017-540898, Jan. 9, 2018, 7 pages.

PCT International Search Report and Written Opinion, PCT Application No. PCT/US16/29851, Aug. 12, 2016, 21 pages.

PCT International Search Report and Written Opinion, PCT Application No. PCT/US2019/015037, Jun. 20, 2019, 11 pages.

The Mexican Institute of Industrial Property, First Office Action, MX Patent Application No. 17/009765, filed Aug. 6, 2018, 7 pages.

United States Office Action, U.S. Appl. No. 16/677,302, filed Apr. 15, 2020, 9 pages.

United States Office Action, U.S. Appl. No. 15/368,363, filed Oct. 24, 2018, 12 pages.

United States Office Action, U.S. Appl. No. 15/368,363, filed Dec. 26, 2017, 5 pages.

United States Office Action, U.S. Appl. No. 15/885,689, filed Nov. 16, 2018, 11 pages.

United States Office Action, U.S. Appl. No. 16/442,332, filed Jul. 25, 2019, 9 pages.

United States Office Action, U.S. Appl. No. 17/832,435, filed Mar. 2, 2023, 7 pages.

United States Office Action, U.S. Appl. No. 17/832,435, filed Dec. 12, 2022, 9 pages.

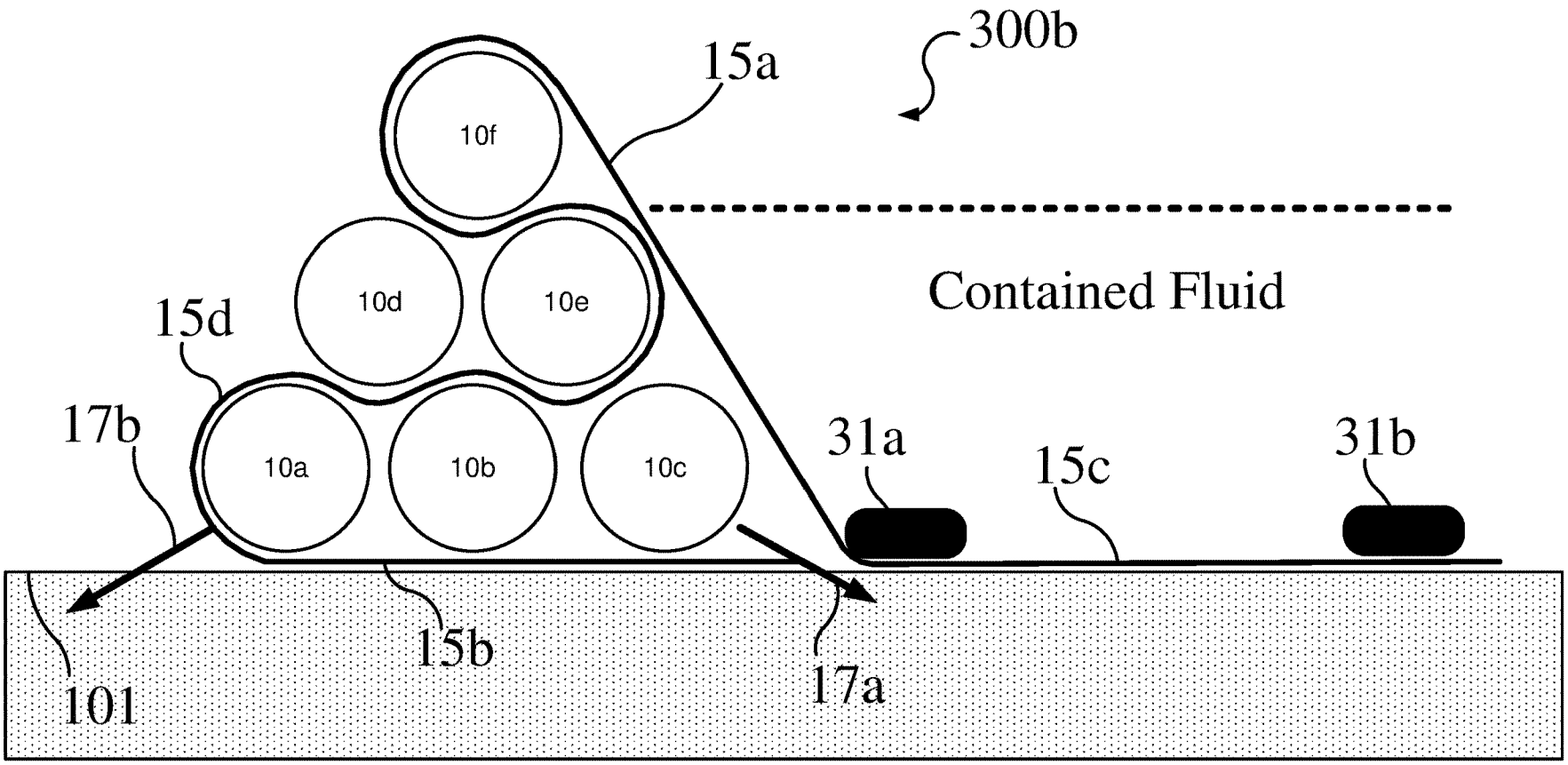
FIG. 3B1

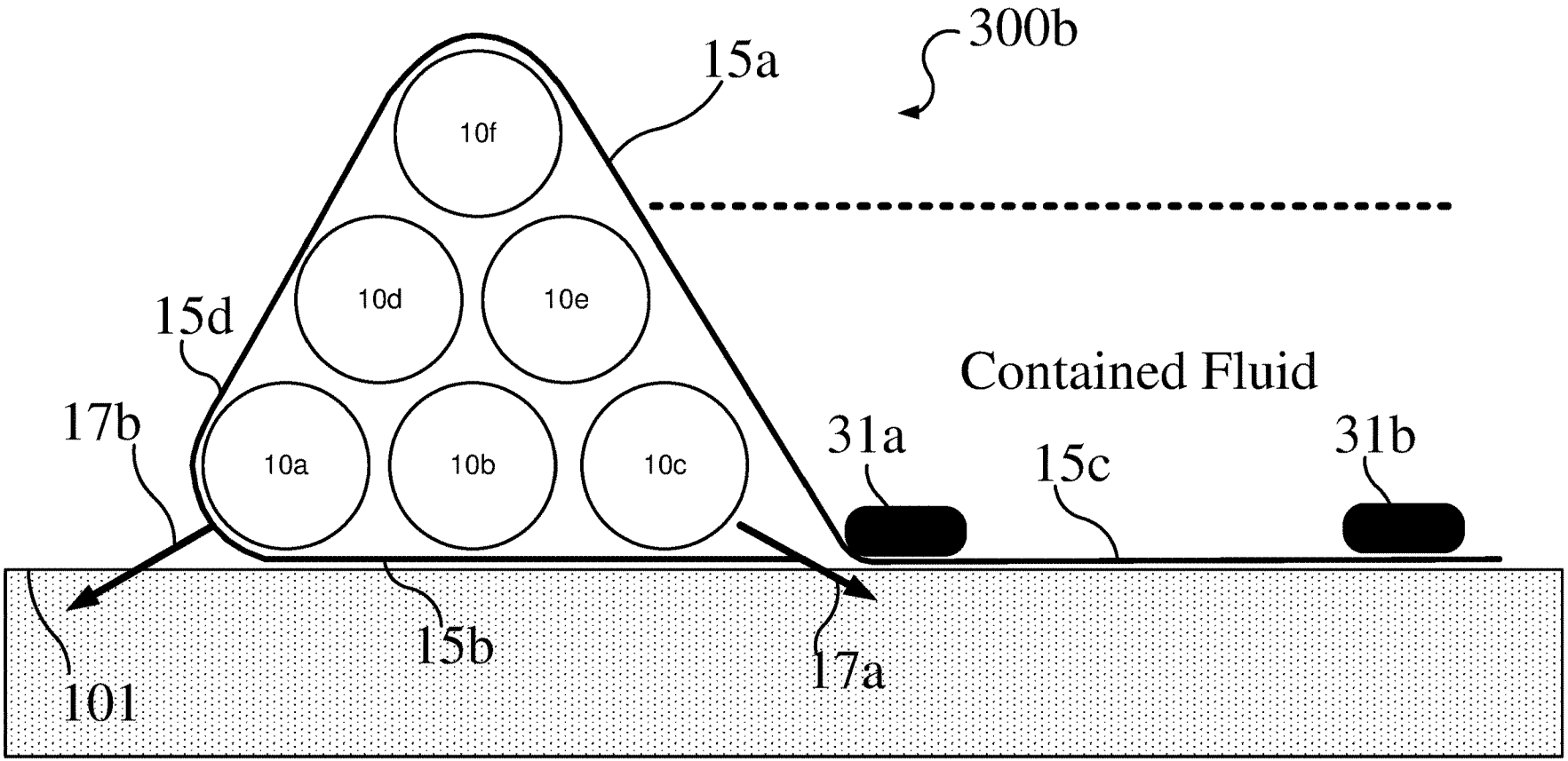
FIG. 3B2

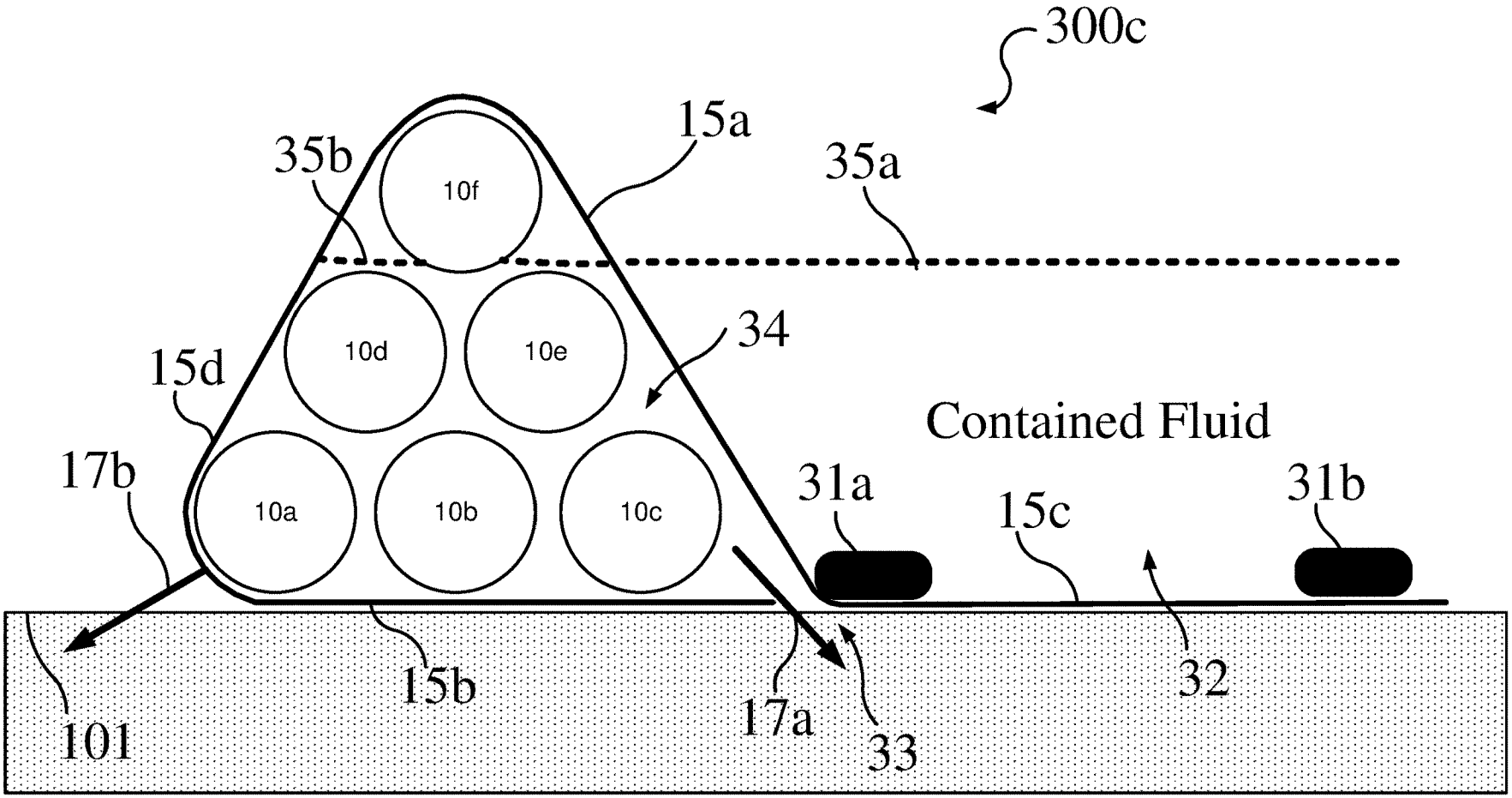
FIG. 3C1

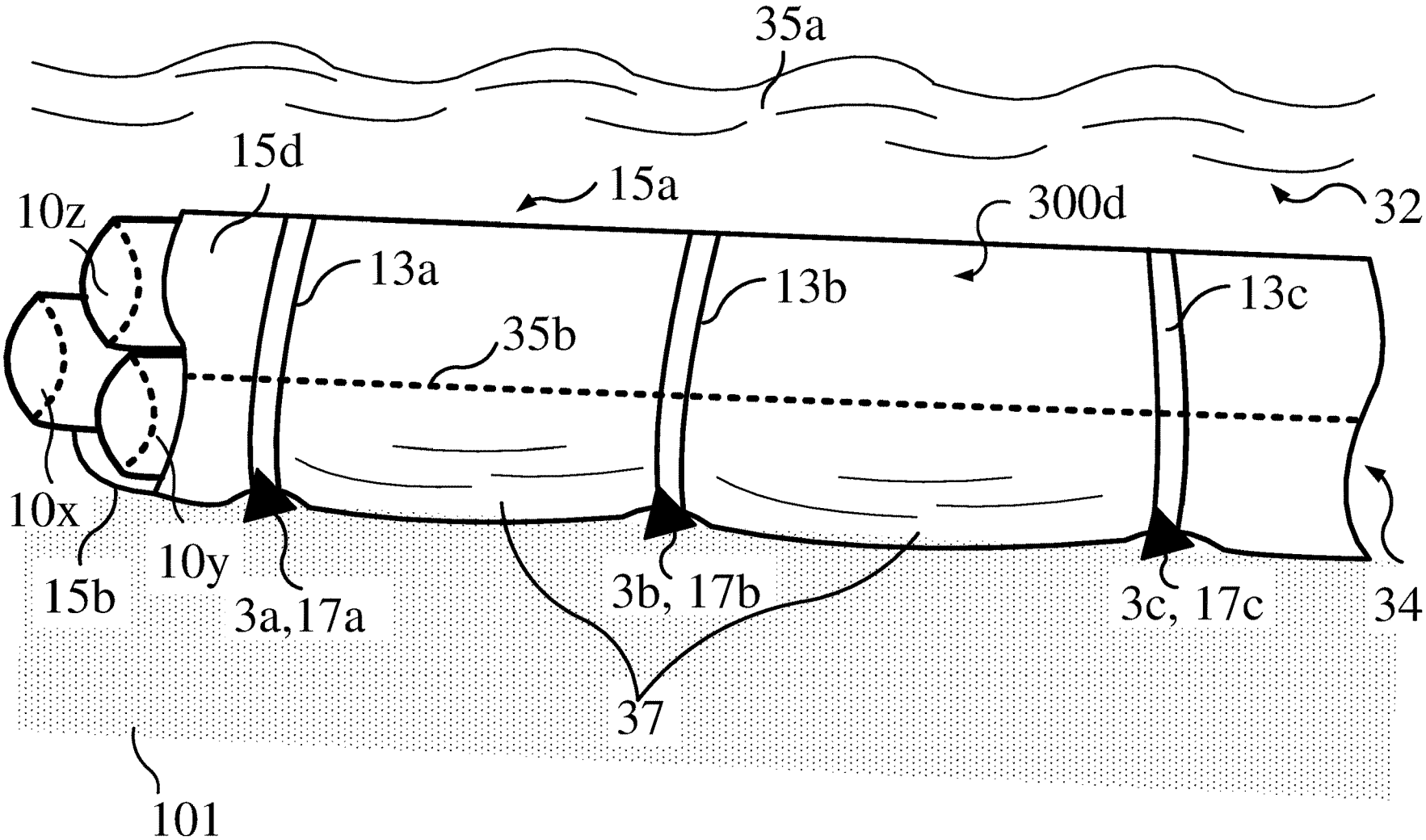
FIG. 3C2

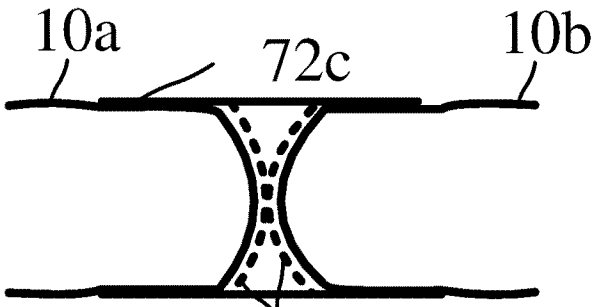
FIG. 7A1
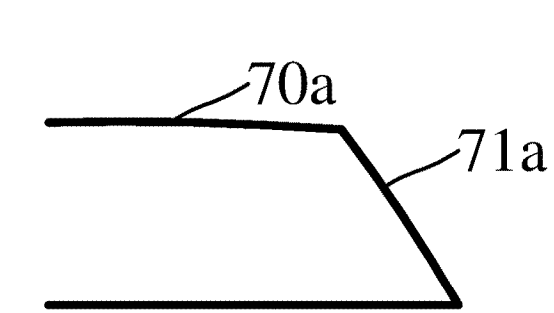
FIG. 7A2
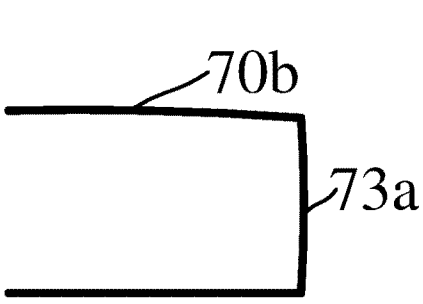
FIG. 7B1
FIG. 7B2
FIG. 7C
FIG. 7D
FIG. 7E Fluid Force Computation for Water

| Height of Fluid (Water) in inches | Lateral Force per 10' of dike in lbs |
|---|---|
| 19 | 782 |
| 20 | 867 |
| 22 | 1049 |
| 24 | 1248 |
| 26 | 1465 |
| 28 | 1699 |
| 30 | 1950 |
| 32 | 2219 |
| 34 | 2505 |
| 36 | 2808 |
| 38 | 3129 |
| 40 | 3467 |
| 50 | 5417 |
| 60 | 7800 |
| 70 | 10617 |
| 80 | 13867 |

| Fluid Depth (Water) ft | Downward Force from volume of fluid over the dike for 1V:1H in lbs/ft length of dike | 50' of dike |
|---|---|---|
| 2 | 125 | 6240 |
| 3 | 281 | 14040 |
| 4 | 499 | 24960 |
| 5 | 780 | 39000 |
| | | |
| Fluid Depth (Water) ft | Lateral force lbs/ft length of dike | 50' of dike |
| 2 | 125 | 6240 |
| 3 | 281 | 14040 |
| 4 | 499 | 24960 |
| 5 | 780 | 39000 |

FIG. 10

CONTAINMENT DIKE

CROSS REFERENCE TO RELATED APPLICATION

This application is a continuation of U.S. Utility application Ser. No. 17/832,435, filed Jun. 3, 2022, which is a continuation of U.S. Utility application Ser. No. 16/784,059 (now U.S. Pat. No. 11,384,497), filed Feb. 6, 2020, which is a continuation of U.S. Utility application Ser. No. 16/442,332 (now U.S. patent Ser. No. 10/584,454), filed Jun. 14, 2019, which is a continuation of U.S. Utility application Ser. No. 15/368,363 (now U.S. Pat. No. 10,378,168), filed Dec. 2, 2016, which is a continuation of U.S. Utility application Ser. No. 15/141,267 (Now U.S. Pat. No. 9,528,236), filed on Apr. 28, 2016, which claims priority to U.S. Provisional Application No. 62/155,269, filed on Apr. 30, 2015, all of which are incorporated by reference herein in their entirety.

BACKGROUND

1 Field of the Disclosure

The present disclosure relates to flexible containment tubes for dikes and specifically to improving their resiliency and utility in the field.

2. Description of the Related Art

Many systems have been employed for controlling the spread of flood waters or fluid spills. One of the most common means for containing or diverting a flow of liquid is sandbagging where empty bags are filled with sand and piled to form a temporary dike. Sandbagging to temporarily divert liquid flow has certain disadvantages, including the monetary cost of producing the sandbags, monetary cost of sand filler, time cost of filling empty sand bags, and the difficulty of removing filled sand bags when they are no longer required. Additionally, temporary sand bag dikes, while effective at diverting some liquid flow, are not sufficient to contain liquids.

In other areas, specifically those related to longer-term above-ground fluid storage and diversion, expensive infrastructure and/or construction methods are needed to contain and divert fluids. For example, in the case of long term containment, pools are dug out with heavy machinery or permanent containment structures such as tanks are transported and installed or built on site. Such methods, while effective for permanent containment of a fixed amount of liquid or diversion, involve significant cost and man-hours to implement.

BRIEF DESCRIPTION OF THE DRAWINGS

The teachings of the embodiments can be readily understood by considering the following detailed description in conjunction with the accompanying drawings.

Figure

FIG. 3B1 and FIG. 3B2 are diagrams illustrating a vapor barrier configuration in constructing a diversion dike according to example embodiments.

FIG. 3C1 and FIG. 3C2 are diagrams illustrating a vapor barrier configuration in constructing a diversion dike according to example embodiments.

FIG. 7A1, FIG. 7A2, FIG. 7B1, FIG. 7B2, FIG. 7C, FIG. 7D, and FIG. 7E are diagrams illustrating flexible containment tube abutments according to example embodiments.

FIG. 10 is a diagram showing the downward force of a contained fluid increasing with the force of hydrostatic pressure as the height of a contained fluid rises.

DETAILED DESCRIPTION OF EMBODIMENTS

Figure 1:
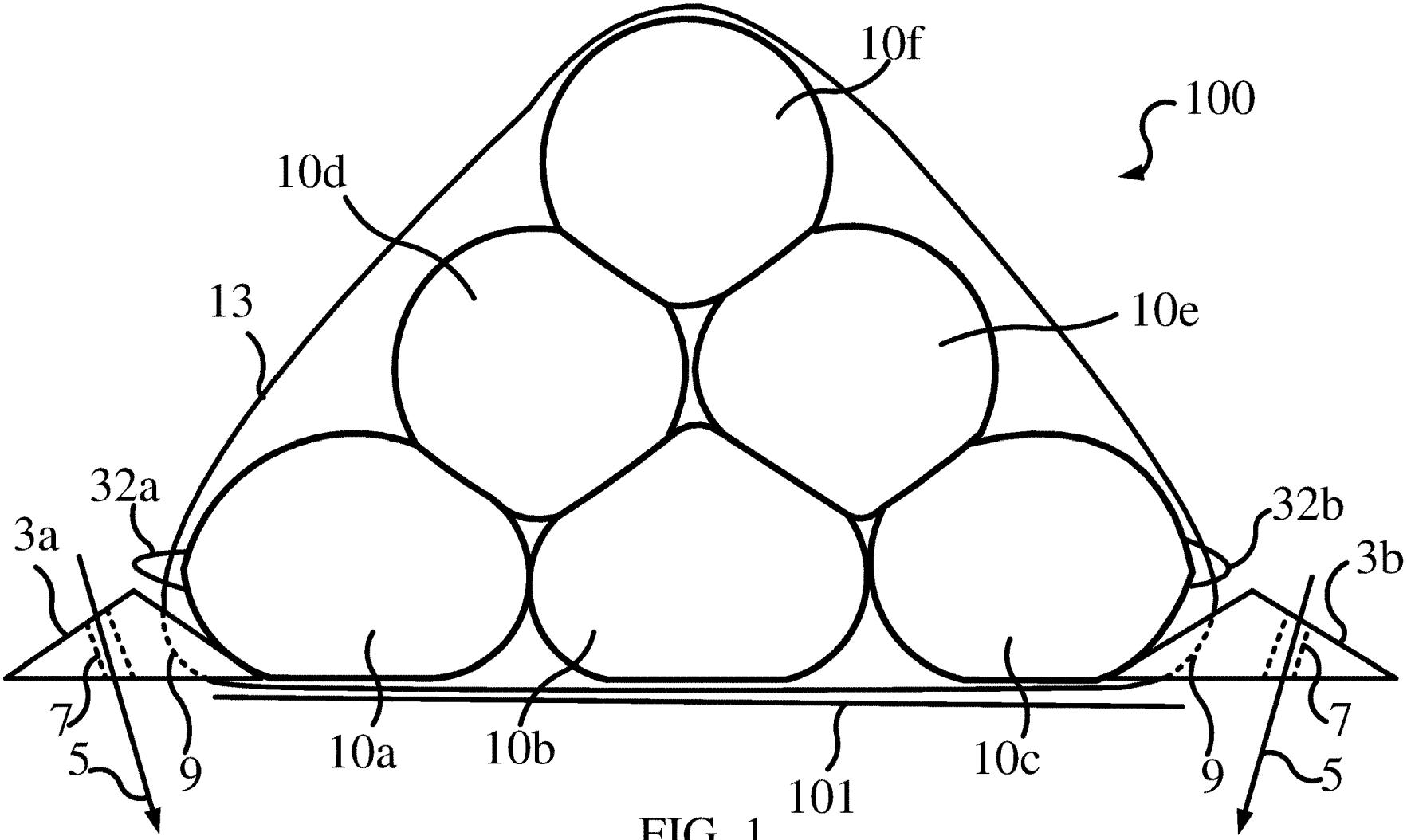
(FIG. 1 is a diagram illustrating an earthen anchor for securing a diversion dike according to an example embodiment.

The Figures (FIG.) and the following description relate to preferred embodiments by way of illustration only. It should be noted that from the following discussion, alternative embodiments of the structures and methods disclosed herein will be readily recognized as viable alternatives that may be employed without departing from the principles of the embodiments.

Reference will now be made in detail to several embodiments, examples of which are illustrated in the accompanying figures. It is noted that wherever practicable, similar or like reference numbers may be used in the figures and may indicate similar or like functionality. The figures depict embodiments for purposes of illustration only.

Overview

Historically, sand bags were constructed on-site (or off-site and delivered) for hand-building barriers for temporarily containing or diverting a flow of liquid. This method of barrier construction for fluid containment and diversion is extraordinarily time consuming, requiring large teams of people to construct and/or place the sand bags and additionally large quantities of specific raw material (sand) for the filling of the sand bags. Further, tear-down of the barrier requires equally large teams of people to facilitate the removal of the raw material from the barrier site.

In other areas of fluid containment, large earthen or other man-made containment ponds were constructed by digging out a large section of leveled acreage or constructing earthen barriers thereon, and often utilizing a pad (e.g., of poured concrete), to receive and transfer fluids. The majority of leveled acreage for the pad supports fluid storage, the excavation of which (or movement of materials for the pad) requires a significant amount of man and machine hours. In addition, the construction of pads with concrete requires a vast amount of materials and transport thereof to the construction site. Moreover, the concrete itself must be allowed to cure (dry) prior to use in fluid containment. Example containment pond structures created on a pad include dug-out sections for the pad and/or above ground ponds constructed on the level surface.

The shortcomings of the above fluid containment techniques extend beyond cost and man-hours to implement. For example, sand bag containment structures, while relatively simple to construct, are most effective for temporary diversion, not containment. Thus, in terms of mitigating flood damage, a sand bag barrier may prevent a structure (e.g., a house) from washing out through the diversion of flowing water, but are not sufficient enough to prevent standing water intrusion. As for more permanent structures that are more effective than sand bags, their use in mitigating flood damage in a manner similar to sand bags immediately prior to a possible flood event is often not feasible.

Large flexible containment tubes mitigate the reliance on specific raw materials, reduce installation cost, and decrease the number of personnel required to construct a barrier of a given length and height for fluid diversion and containment. For example, one large containment tube (or tube) may take the place of tens, or hundreds of sand bags, for constructing sections of a barrier during a flood for fluid diversion and containment of floodwaters. In another example, one large tube may take the place of a more permanent structure for fluid containment. Further, filling of the tube may be carried out through the use of any liquid substance, such as water, wet concrete, other fluid, or even an expanding and hardening foam (such as polyurethane foam) or gas in certain configurations, which may be pumped into the tube.

The substance for filling the tubes can depend on application, for example, water may be used in the case of temporary barriers constructed for diverting flood waters. In another example, concrete may be used in the case of a more permanent barrier for fluid containment—in which case the concrete, once dry, forms a barrier in place of a body of the tube itself.

In one implementation, multiple flexible containment tubes may form a section of a dike for flood diversion. For example, multiple vinyl-coated polyester tubes with a 19-inch diameter may be filled with water and stacked on top of each other to create a temporary diversion dike. Multiple sections of dike may be abutted together to form longer sections of dike. These temporary sections can be erected by stacking multiple tubes in a pyramid fashion and filling each flexible containment tube with water from the approaching flood or water from local hydrants (or other means). The containment tubes may be secured together with polyester strapping, and fastened to the ground with anchors, such as a screw-type anchor (ground stake). Additionally, a vapor barrier or plastic membrane may wrap over dike sections and/or weaved through the flexible containment tubes as they are placed prior to filling to create a seepage barrier (e.g., within the dike section and between abutting dike sections) and reinforce the dike sections. Further, ground sheet weights and/or additional ground anchors may secure a portion of the vapor barrier extending into the containment area.

Example Fluid Containment Tubes and Related Structures

Figure (FIG. 1 is a diagram illustrating an earthen anchor for securing a diversion dike according to an example embodiment. As shown, a section of diversion dike 100 includes a number of flexible containment tubes 10 stacked in a pyramid shape. Namely, for a pyramid type shape, a base layer includes a number of tubes, and the number of tubes decreases as additional layers are added. As shown, the illustrated section of diversion dike 100 in a 3-2-1 pyramid configuration having a base layer (e.g., first layer) of three tubes 10*a*, 10*b*, 10*c*, which decreases by one for each subsequent layer (e.g., tubes 10*d*, 10*e* in the second layer and tube 10*f* in the top layer). Other configurations may include additional or fewer base tubes in the first layer, and may have top layers including more than one tube. For example, a 4-3-2-1, 5-4-3, 5-3-2-1 etc. pyramid configurations may be realized.

In one embodiment, the tubes 10 are flexible fluid containment structures placed in a desired configuration such as singularly or in a pyramid shaped dike section 100 as illustrated in FIG. 1. Tubes 10 may be placed end-to-end to construct diversion dikes longer than the tube body itself. In some embodiments, dike sections 100 may be arranged to form a corral or enclosed area (e.g., a square, circle, rectangle, or other shape), either to hold in fluid for containment or divert fluids. In such instances, the position of tube ends may be staggered. Thus, for example, the ends of the tubes 10 illustrated in FIG. 1 may not be coplanar, but staggered when additional diversion dike sections are abutted together to create longer barriers or angles between one dike section and another.

An example flexible containment tube 10, when filled, may be approximately 100 feet long, with a diameter from 1 foot to exceeding 3 feet and have a volume in excess of 750,000 gallons. Accordingly, tube weight may range from approximately 3 tons to much greater based on dimensions and the material utilized to fill them (e.g., water versus concrete or significantly lighter when utilizing a gas). Prior to filling, the tube may be rolled up along its length for compact storage and transportation. Due to their flexible nature, the length of each containment tube 10 may be positioned when empty to take on be nearly any shape, e.g., a square, a "7", an arc, etc. to construct the barriers around structures and avoid obstacles. For example, in areas where trees, other obstacles or land boundaries need to be accounted for, the tubes 10 may be easily positioned around the trees or other obstacles when empty and then filled.

The tubes 10 themselves are configured to store fluid such as water or gas (e.g., air), concrete or other substance, which may be readily available on-site. Valves may be disposed in the flexible body of the flexible containment tube to receive fluid from a coupling to a filling apparatus facilitating the flow of fluid into the tube via one or more valves. A valve may further be configured to prevent undesired release of the fluid. Hence, once placed around obstacles in a desired configuration, one or more tubes may be filled via a fluid filling apparatus coupled to the valve. Example fluid filling apparatuses may include a pump or hose or pipe, which may be supplied with fluid by a pump or gravity, and in the case of gas, a pressurized canister or compressor. In practice, for example, once a base layer of tubes 10*a-c* are placed, they may be filled via filling apparatus such as a hose and pump coupled to values disposed in the respective tubes, and additional tubes (e.g., tubes 10*d-f*, or abutting tubes (not shown)) may be placed and subsequently filled via the filling apparatus as desired to provide on-demand fluid containment or diversion.

A tube 10 or number of tubes (e.g., those in a pyramid configuration) may be secured in a variety of fashions, several of which are illustrated by example for diversion dike section 100. According to one embodiment, a tube 10 may include one or more strap loops 32 coupled to the flexible body of the tube. The strap loops 32 have a diameter great enough to accommodate a strap 13 of a given with. For example, a given strap loop 32 may have a 2.75 in diameter to accommodate a strap 13 with up to a 2.5 in width, a 3.25 in diameter to accommodate a strap 13 up to a 3 in width and so forth. Strap loops 32 coupled to the flexible body of a tube 10 aid in preventing, with the use of a corresponding strap 13, the shifting of tubes along their length, and further aid in maintaining the position of tubes in their desired configuration for the dike section 100. While only two strap loops 32*a*, 32*b* are illustrated, one for each of tubes 10*a* and 10*c*, respectively, tubes 10*a* and 10*c* may include additional strap loops 32 positioned around and down their flexible bodies as desired. Further, the other tubes may include strap loops (not shown) to accommodate a strap 13 proximate to the flexible body. For example, one or more of tubes 10*b*, 10*d*, 10*f*, and 10*e* may include strap loops coupled to their flexible bodies such that strap 13 may be inserted through the strap loops to maintain the position of the tubes. In larger pyramid formations, e.g., 4-3-2-1, with interior tubes 10 not proximate to a given strap 13 wrapped around the exterior of the dike section, a strap may be interweaved between the tubes and/or addition straps may be utilized. For example, a first strap may be utilized to wrap around a the exterior of a 4-3-2-1 dike section and a second strap utilized to wrap around the 3-2-1 portion, which may further be inserted through strap loops coupled to tubes making up the 4 tube base layer.

As shown, strap 13 is routed through the strap loops 32*a*, 32*b* of tubes 10*a* and 10*c*, respectively, and around the dike section 100 to secure the tubes 10 of the dike section together. Although not shown, the strap 13 may be routed through any additional number of strap loops (also not shown) of the other tubes. While, as described above, the strap loops 32 and strap 13 aid in preventing the shifting of tube along their length and maintain the tubes in their desired configuration for the dike section 100, they do not prevent the shifting of the entire dike section 100 with respect to the ground 101.

In an embodiment, earthen anchors 3 secured to the ground 101 aid in preventing the shifting of an individual tube or dike section 100 with respect to the ground 101. As shown, an earthen anchor (e.g., 3*a* and 3*b*) may be placed adjacent to the body of a tube (e.g., 10*a* and 10*c*) at the edges of the base level along its length. Example earthen anchor 3*a* includes a ground securing mechanism, such as a stake 5 and stake driving portion 7. For example, the driving portion 7 may be an opening in the earthen anchor 3*a* to receive the stake 5. The configuration of the stake 5 and the driving portion 7 may be such that the driving portion may receive the tip and shaft of the stake driven into the ground 101, but not the other end of the stake. In this way, once the stake 5 is sufficiently driven into the ground 101 through the driving portion 7, the anchor 3*a* may not be removed from the stake 5. In other words, once the stake 5 is driven into the ground 101 through the stake driving portion 7, the earthen anchor 3*a* remains secure to the ground 101 until the stake 5 is removed from the ground 101.

Embodiments of a stake 5 may differ based on the composition of the ground 101. For example, a stake 5 for a concrete ground surface may differ from a stake for soil, clay, sand, etc. Further, different lengths of stakes 5 may be chosen to reach a certain depth in the ground 101 based on the ground type. For example, a stake 5 for concrete may be of a shorter length than a stake for soil, however, they may provide similar resistance to removal. The stake 5 may be configured with a helical ridge beginning at the tip driven into the ground 101 and extending up the shaft towards the opposite end, similar to that of a screw, such that rotation of the stake in one direction drives the tip of the stake further into the ground 101 and rotation of the stake in the opposite direction backs the stake out of the ground.

An earthen anchor 3 may include a strap loop 9 disposed in the earthen anchor, which the strap 13 around the tubes 10 may be routed through or otherwise attached to (e.g., at an end of the strap). A strap loop 9 may be configured with a diameter similar to strap loop (e.g., 32*a*) to receive the strap 13. Inclusion of the strap loop 9 secures the earthen anchor 3 against the adjacent tube 10 and the tube against the anchor. For example, as shown, strap 13 is routed through the strap loop 9 of earthen anchor 3*a* to secure the earthen anchor 3*a* against the body of tube 10*a*. In some embodiments, only stakes 5 may be used, in which case the top ends of the stakes 5 include a strap loop to receive the strap 13. An example strap loop at the top end of a stake 5 may be a metal eye, or hook having a sufficient diameter or opening to receive the strap 13 itself.

One or more additional earthen anchors (not shown) may be placed along the length of the body of the tube 10*a* as desired. Additionally, as shown, earthen anchors 3*a*, 3*b*, may be placed on each side of a dike section 100 (or, in other embodiments, an individual tube) along its length. Earthen anchor 3*b* may be configured in a fashion similar to that of earthen anchor 3*a* to secure the anchor 3*b* against tube 10*c* and to the ground 101 to prevent shifting of the dike section 100 with respect to the ground.

Figure 9:
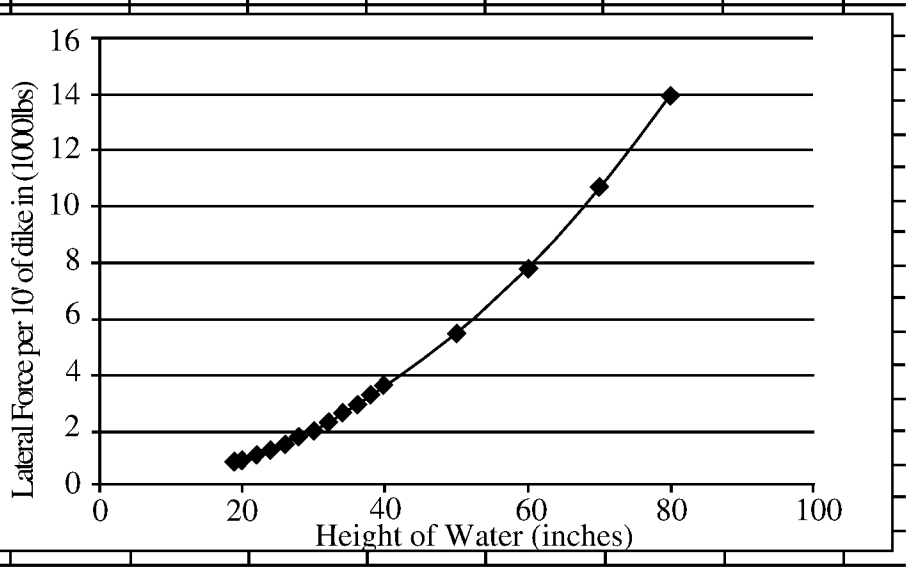
FIG. 9 is a diagram showing the force of hydrostatic pressure increasing with height of a contained fluid.

The number of anchors 3 per length of dike section 100 may depend on the length of the dike section, and the height of the dike section. The higher the dike section 100, the more anchors 3 may be used because the horizontal force of the contained fluid on the dike section increases with depth of the contained fluid. This horizontal force is known as hydrostatic pressure, or Hk, which is characterized by the specific weight of the contained fluid (r) and the square of the depth (h) of the contained fluid. Specifically, Hk=(r/2) *h^2 with a line of action of Hk at h/3 above the base of the dike section. The dike section 100 must resist the hydrostatic pressure to remain in place. Referring briefly to FIG. 9, a graph is shown illustrating the exponential growth of force (in 1000 lbs) per 10 feet of dike section 100 due to hydrostatic pressure with increase of height in inches of the contained fluid. In one embodiment, approximately three anchors 3, each with a stake providing 2-10 tons of securing force are utilized per 100 ft length of dike section 100 per tube 10 in a pyramid configuration (as the number of tubes correlates to height of the dike section and thus the possible height of contained fluid). In the above securing scheme, a safety factor may be built in to protect against additional horizontal forces such as wave action that increase the force a dike section 100 must withstand over the hydrostatic pressure alone. For example, if the securing force provided by the number of stakes utilized per dike section is closely matched to the hydrostatic pressure, the weight of the tubes themselves in conjunction with the other strengthening features described herein (e.g., inclusion of a vapor barrier extending into the containment area) may provide a sufficient safety factor.

Figure 2:
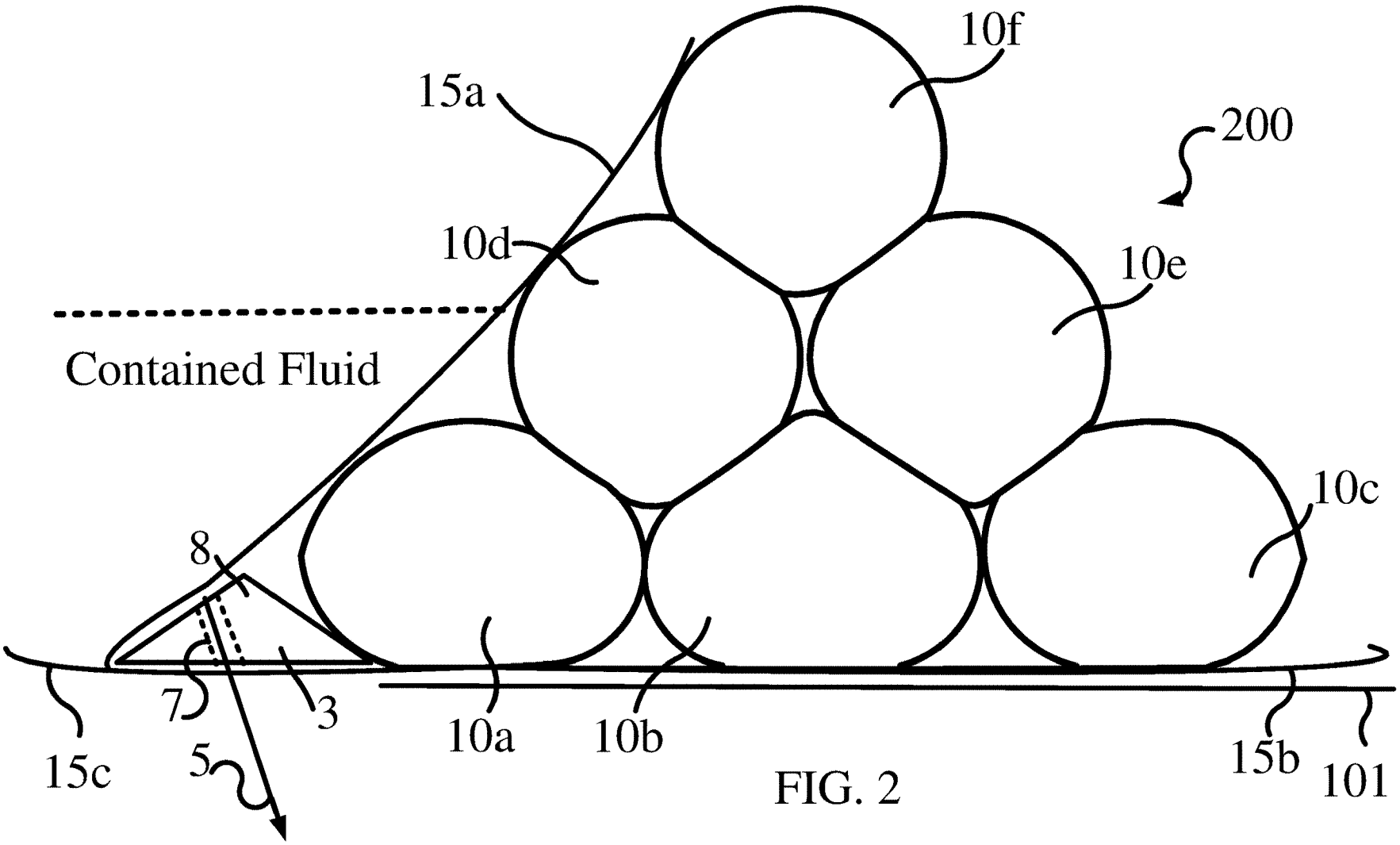
FIG. 2 is a diagram illustrating an earthen anchor for securing a vapor barrier according to an example embodiment.

FIG. 2 is a diagram illustrating an earthen anchor for securing a vapor barrier 15 according to an example embodiment. The earthen anchor 3 shown in FIG. 2 may be of a configuration similar to that of FIG. 1. For example, the earthen anchor 3 may include a strap loop (not shown) for securing the anchor against tube 10*a* with a strap, which may be wrapped around the dike section 200 or through tubes 10 within the dike section. The tubes 10 themselves of dike section 200 are shown with a configuration similar to that of FIG. 1.

Over the embodiment of FIG. 1, the dike section 200 illustrated in FIG. 2 includes a vapor barrier 15 to provide additional resistance against the intrusion of fluid through the dike section 200. In one embodiment, the vapor barrier 15 is a watertight material, such as poly visqueen or other material that prevents intrusion of fluid through its surface. In an embodiment, the poly visqueen is between 5-15 millimeters in thickness. In some embodiments, the poly visqueen is reinforced, for example, with an embedded webbing material such as nylon strands (e.g., string).

The vapor barrier 15 may wrap over, underneath, and/or through the tubes of a dike section 200 depending on the configuration. Additionally, the vapor barrier 15 may extend along a portion or entire length of the dike section 200, and may include multiple overlapping sections to extend over the entire length or portion of the dike section. In one embodiment, the vapor barrier 15 extends over a length of the dike section 200 where tube ends are abutted against each other (e.g., at a junction of two dike sections 200) to create longer dike sections than the tubes 10 themselves. The junction of two dike sections 200 may be in a line, at an angle, or other configuration. In the case of a pyramid dike section 200, one or more tubes may be staggered to facilitate a bend (e.g., tubes 10*b*, 10*c*, 10*e* on the interior of the barrier may be staggered back from tubes 10*a*, 10*d*, 10*f* for a right bend). Similarly, corresponding tubes of an additional dike section may be configured (e.g., staggered) such that they abut to the tubes 10 of dike section 200 to form a junction that bends to the right.

A vapor barrier 15 configuration may include a portion that extends from under the rear 15*b* of the dike section 200 and a portion that extends up the front 15*a* of the dike section from the front base of the dike section forming part of the containment area. In the illustrated configuration, the vapor barrier 15 extends under the earthen anchor 3, which secures the vapor barrier 15 to the ground 101 through the driving of stake 5 into the ground 101 through the vapor barrier. Further, the vapor barrier 15 may be folded at the rear portion 15*b* such that a front portion 15*a* may extend up the front face of the dike section 200 from the front base of the dike section and an additional portion 15*c* may extend from the front base of the dike section along the ground 101 into the fluid containment area. The additional portion 15*c* may extend 1-3 yards or longer from the front base of the dike section 200 within the containment area to mitigate erosion of the ground 101 under the dike section 200 by the contained fluid. The additional portion 15*c* may be secured at the extended end to the ground 101 with additional earthen anchors and/or with weights (not shown).

The earthen anchor 3 may be configured with a slopped face 8 to provide a gradual incline leading up to the body of the adjacent tube 10*a* for the portion 15*a* of the vapor barrier to lie on as it extends up the front face of the dike section 200 from the front base forming the containment area. Additionally, the driving portion 7 of the earthen anchor 3 may be configured such that the driving end of the stake 5 does not extend past the slopped face 8 of the earthen anchor 3. In such a way, tearing or puncture of the portion 15*a* of the vapor barrier leading up the front face of the dike section 200 within the containment area may be mitigated.

Figure 3A:
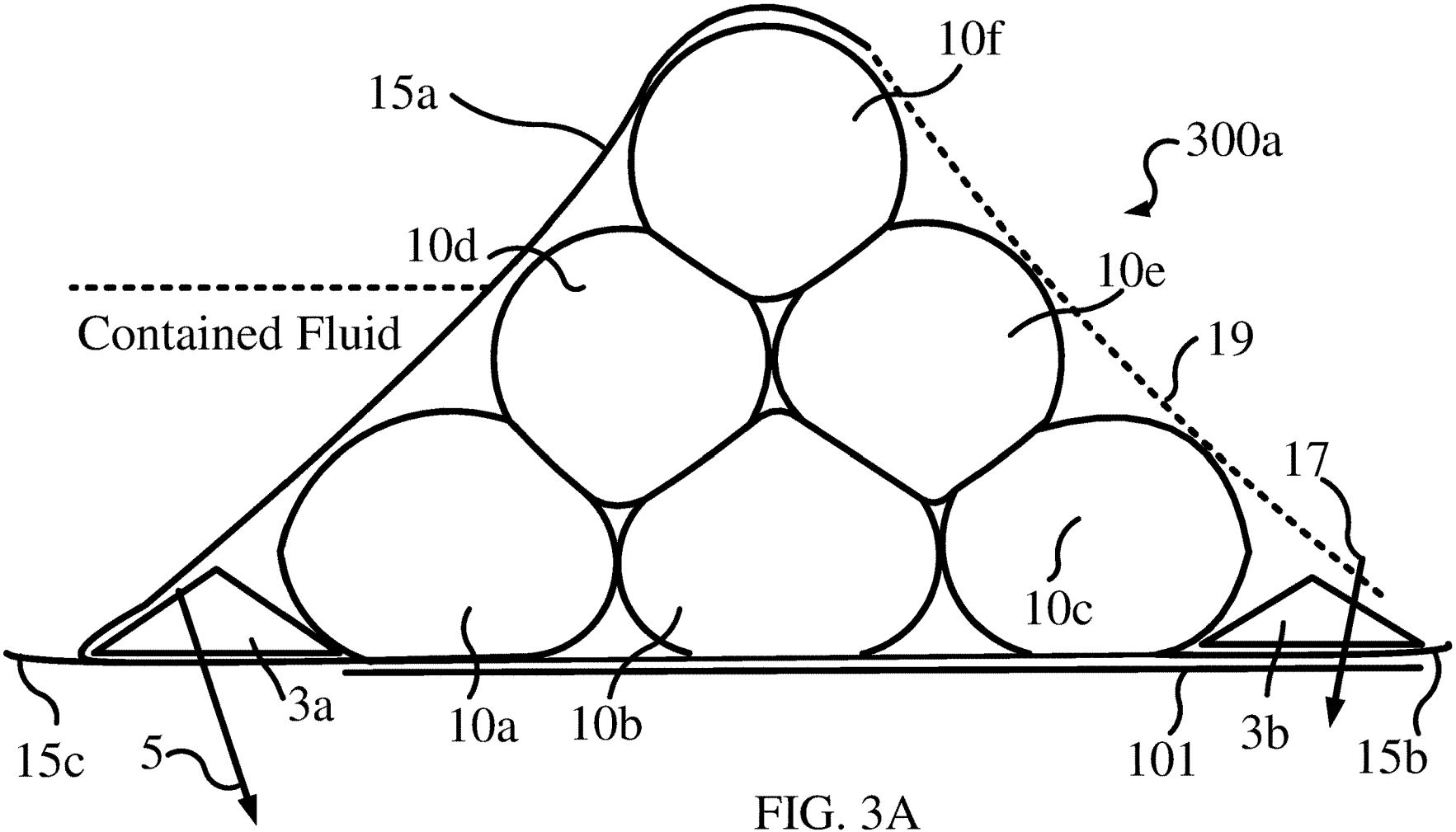
FIG. 3A is a diagram illustrating a vapor barrier configuration in constructing a diversion dike according to an example embodiment.

FIG. 3A is a diagram illustrating a vapor barrier 15 configuration in constructing a diversion dike according to an example embodiment. The earthen anchors 3*a*, 3*b* shown in FIG. 3A may be of a configuration similar to that of FIG. 1. For example, the earthen anchors 3*a*, 3*b* may include a strap loop (not shown) for securing the anchor against tubes 10*a*, 10*c*, respectively, with a strap, which may be wrapped around the dike section 300*a* or through tubes 10 within the dike section. The tubes 10 themselves of dike section 300*a* are shown with a configuration similar to that of FIG. 1.

Over the embodiment of FIG. 1, the dike section 300*a* illustrated in FIG. 3A includes a vapor barrier 15 to provide additional resistance against the intrusion of fluid through the dike section 300*a*. In one embodiment, the vapor barrier 15 is a watertight material, such as poly visqueen or other material that prevents intrusion of fluid through its surface. In an embodiment, the poly visqueen is between 5-15 millimeters in thickness. In some embodiments, the poly visqueen is reinforced, for example, with an embedded webbing material such as nylon strands (e.g., string).

The vapor barrier 15 may wrap over, underneath, and/or through the tubes of a dike section 300*a* depending on the configuration. Additionally, the vapor barrier 15 may extend along a portion or entire length of the dike section 300*a*, and may include multiple overlapping sections to extend over the entire length or portion of the dike section. In one embodiment, the vapor barrier 15 extends over a length of the dike section 300*a* where tube ends are abutted against each other (e.g., at a junction of two dike sections 300*a*) to create longer dike sections than the tubes 10 themselves. The junction of two dike sections 300*a* may be in a line, at an angle, or other configuration. In the case of a pyramid dike section 300*a*, one or more tubes may be staggered to facilitate a bend (e.g., tubes 10*b*, 10*c*, 10*e* on the interior of the barrier may be staggered back from tubes 10*a*, 10*d*, 10*f* for a right bend). Similarly, corresponding tubes of an additional dike section may be configured (e.g., staggered) such that they abut to the tubes 10 of dike section 300*a* to form a junction that bends to the right.

A vapor barrier 15 configuration may include a portion that extends from under the rear 15*b* of the dike section 300*a* and up the front 15*a* of the dike section from the front base of the dike section forming part of the containment area. As shown in the illustrated configuration, the vapor barrier 15 extends under the earthen anchor 3*a*, which secures the vapor barrier 15 to the ground 101 through the driving of stake 5 into the ground 101 through the vapor barrier 15. Further, the vapor barrier 15 may be folded at the rear portion 15*b* such that a front portion 15*a* may extend up the front face of the dike section 300*a* from the front base of the dike section and an additional portion 15*c* may extend from the front base of the dike section along the ground 101 into the fluid containment area. The additional portion 15*c* may extend 1-3 yards or longer from the front base of the dike section 300*a* within the containment area to mitigate erosion of the ground 101 under the dike section 300*a* by the contained fluid. The additional portion 15*c* may be secured at the extended end to the ground 101 with additional earthen anchors and/or with weights (not shown).

In one embodiment, the earthen anchor 3*a* is configured with a slopped face to provide a gradual incline leading up to the body of the adjacent tube 10*a* for the portion 15*a* of the vapor barrier 15 to lie on as it extends up the front face of the dike section 300*a* from the front base forming the containment area. Further, in some embodiments a driving portion (not shown) of the earthen anchor 3*a* through which the stake 5 is driven is configured such that the driving end of the stake 5 does not extend past the slopped face of the earthen anchor. In such a way, tearing or puncture of the vapor barrier portion 15*a* leading up the front face of the dike section 300*a* within the containment area may be mitigated.

In the embodiment illustrated in FIG. 3A, a second earthen anchor 3*b* secured to the ground 101 via the driving of stake 17 further secures the rear end of portion 15*b* of the vapor barrier 15 to the ground 101, e.g., through the positioning of the rear end of portion 15*b* of the vapor barrier 15*b* under the earthen anchor 15*b* at the rear base of the dike section 300*a* and the driving of stake 17 through the rear end of portion 15*b* of the vapor into the ground. Additionally, the vapor barrier portion 15*a* extending up the front face of the dike section 300*a* from the front base of the dike section is secured over the top of the dike section 300*a* to the earthen anchor 3*b*, e.g., via a connecting strap 19 to stake 17 or to a strap loop (not shown) of the earthen anchor 3*b*. In some embodiments, the front portion 15*a* of the vapor barrier 15 may be of sufficient length to extend over the top of the dike section 300*a* and to the rear base of the dike section to be secured to or via the earthen anchor 3*b* without the aid of a connecting strap 19. In either instance, the vapor barrier 15 is secured to the ground 101 via earthen anchors, stakes and/or straps.

Securing the vapor barrier 15 to the ground 101 on both sides of a dike section 300*a* of one or more tubes 10 provides some unexpected benefits. The tubes 10 themselves may also be secured to the ground 101 (e.g., as explained with reference to FIG. 1). Thus, for example, in instances where the vapor barrier 15 is impervious to fluid, such as in the case of a vapor barrier constructed of poly visqueen, the tubes 10 need only provide shape to dike section 300*a* as the portion of vapor barrier 15*a* extending up the front face of the dike section from the front base within the containment area substantially prevents fluid transfer through the dike section. Accordingly, in such a configuration as that illustrated in FIG. 3A, the tubes 10 may be filled with a substance of substantially different density than the fluid being contained. For example, when considering containment of a fluid such as water, the tubes 10 may be filled with air or other gas. As the contained fluid rises against the front portion 15*a* of the vapor barrier, the pressure of the fluid increases with depth to compress the front portion of the vapor barrier below the surface of the contained fluid against the body of tube 10*a*, then tube 10*d*, and so on. Due to the pyramid shape of the dike section 300*a* and front portion 15*a* of the impervious vapor barrier being pressed against the tubes along the front face of the dike section within the containment area, as the depth of the contained fluid increases, a column of contained fluid develops over portions of the tubes on the lower levels of the front face of the dike section below the surface of the contained fluid. For example, a column of contained fluid develops over a portion of tube 10*a*, then 10*b*, and so on as they fall below the surface of the contained fluid when contained fluid depth increases. The weight of a column of contained fluid over a portion of a tube below the surface of the contained fluid increases with depth of the contained fluid (i.e., because the height of the column increases with depth of the contained fluid). As the front portion 15*a* of the vapor barrier is impervious to the contained fluid, the weight of the column of fluid developing over a portion of a tube (e.g., 10*a*) presses down on the tube by way of the vapor barrier. This downward force of the weight of the contained fluid acting on the lower level tubes, e.g., tube 10*a*, via the front 15*a* of the vapor barrier acts to aid in preventing shifting of the dike section 300*a*. For example, the downward force works in concert with the one or more anchors, stakes, and/or straps securing the dike section 300*a* to prevent the contained fluid from generating a horizontal force sufficient to dislodge the dike section. Further, due to the downward force generated by configuring a dike section 300*a* in this manner, in some embodiments tubes 10 may be filled with a fluid having a density less than the contained fluid. Specifically, because the tubes along the front face of the dike section 300*a* within the containment area are pressed downward to the ground 101 (and against lower level tubes) by the contained fluid itself as the surface of the contained fluid rises, mitigation of the intrusion of the contained fluid underneath and/or through the dike section and dike strength are vastly improved such that density of the fluid filling the tubes and/or anchor strength may be reduced. In such a way, while wholly filling the tubes with gas may not be implemented in practice, the amount of fluid utilized in filling the tubes 10 may be substantially reduced through partial filling with, for example, water and partial filling with, for example, air without reducing the effectiveness of the dike section 300*a*.

FIG. 3B1 and FIG. 3B2 are diagrams illustrating a vapor barrier 15 configuration in constructing a diversion dike according to example embodiments. The stakes 17*a* and 17*b*, although not shown, may be driven through an earthen anchor to secure the vapor barrier 15 to the ground 101. In some embodiments, stake 17*a* and/or stake 17*b* are not utilized to secure the vapor barrier 15 to the ground 101 because the weight of the tubes 10 holds the vapor barrier to the ground. For example, only front stakes 17*a* may be implemented to secure the vapor barrier 15 to the ground 101. The tubes 10 themselves of dike section 300*b* are shown with a configuration similar to that of FIG. 1.

The dike section 300*b* illustrated in FIG. 3B1 includes a vapor barrier 15 to provide additional resistance against the intrusion of fluid through the dike section 300*b* and additional strengthening of the dike section 300*b*. In one embodiment, the vapor barrier 15 is a watertight material, such as poly visqueen, to prevent intrusion of contained fluid through its surface.

The vapor barrier 15 may wrap over, underneath, and/or through the tubes of a dike section 300*b* depending on the configuration. Additionally, the vapor barrier 15 may extend along a portion or entire length of the dike section 300*b*, and may include multiple overlapping sections to extend over the entire length or portion of the dike section. In one embodiment, the vapor barrier 15 extends over a length of the dike section 300*b* where tube ends are abutted against each other (e.g., at a junction of two dike sections 300*b*) to create longer dike sections than the tubes 10 themselves. The junction of two dike sections 300*b* may be in a line, at an angle, or other configuration. In the case of a pyramid dike section 300*b*, one or more tubes may be staggered to facilitate a bend (e.g., tubes 10*b*, 10*c*, 10*e* on the interior of the barrier may be staggered back from tubes 10*a*, 10*d*, 10*f* for a right bend). Similarly, corresponding tubes of an additional dike section may be configured (e.g., staggered) such that they abut to the tubes 10 of dike section 300*b* to form a junction that bends to the right.

Over the embodiment of FIG. 3A, the vapor barrier 15 in FIG. 3B1 includes a portion 15*b* that extends from under the front base of the dike section 300*b* to the rear base of the dike section, a portion 15*d* that wraps around the rear and over the top of the dike section, and a portion 15*a* that extends from the top of the dike section down the front face of the dike section 300*b* to the front base of the dike section with a portion 15*c* continuing to extend along the ground 101 from the front base of the dike section into the fluid containment area. As shown, the vapor barrier 15 may be secured to the ground 101 by ground stake 17*a* at the front, and optionally an additional stake 17*b* at the rear, which may be driven through ground anchors (not shown). The portion 15*c* of the vapor barrier extending out in front of the dike section 300*b* may extend 1-3 yards or longer from the front base of the dike section into the containment area to mitigate erosion of the ground 101 under the dike section 300*b*. The portion 15*c* of the vapor barrier extending into the containment area may be secured to the ground 101 proximate to the front base of the dike section 300*b* and at its end. For example, portion 15*c* of the vapor barrier may be secured proximate to the front face at the front base of the dike section 300*b* and at the extended end to the ground 101 with additional earthen anchors and stakes (not shown) and/or with weights 31*a* and 31*b*, respectively, as shown.

In the illustrated embodiment, the portion 15*a* of the vapor barrier extending down the front face of the dike section 300*b* and the portion 15*c* of the vapor barrier continuing to extend into the containment area from the front base of the dike section provides some unexpected benefits in resisting the hydrostatic pressure of the contained fluid against the dike section 300*b*. Specifically, with the weight of the column of contained fluid pushing down on portion 15*c* of the vapor barrier, as well as down on the portion 15*a* of the vapor barrier extending down the front face of the dike section 300*b* that is below the surface of the contained fluid, the resulting effect of the downward force of the column of fluid on the vapor barrier is similar to a person standing (e.g., the weight of the fluid) on a board (e.g., the vapor barrier 15) while simultaneously trying to lift the board (e.g., the lateral force due to hydrostatic pressure against the front face of the dike section 300*b*). Turning briefly to FIG. 10, a diagram is shown to illustrate the downward force of an example contained fluid (water) in pounds per foot length of the dike section on a dike with a 1V(vertical):1H(horizontal) ratio in comparison with the lateral force of the contained fluid in pounds per foot length of dike section. The 1V:1H ratio represents an example dike section having a front face with a 45 degree slope, e.g., approximation of a pyramid shaped dike section where for each foot in vertical dike height, the front base of the dike extends one foot horizontally into the containment area. The downward force generated by a contained fluid due to column height increases along with the horizontal force of hydrostatic pressure as the height of a contained fluid rises. The downward force is characterized by the specific weight of the contained fluid (r), the depth (h) of the contained fluid, and ratio of the dike vertical to horizontal. For the example 1V:1H ratio, the downward force generated by fluid with depth (h) equates to r/2*h^2. Thus, as the hydrostatic pressure acts laterally (e.g., horizontally) against the front face of the dike section 300*b*, the downward force of the water column on section 15*c* and the sloped front face 15*a* of the vapor barrier (and thus on the tubes) aids in resisting dike movement due to the lateral force of the hydrostatic pressure.

Continuing with FIG. 3B1, as shown, the portion 15*d* of vapor barrier extending up the rear face from the rear base to the top of the dike section 300*b* may be routed between one or more of the tubes 10 within the interior of the dike section to aid in resisting the pulling action of the downward force of the water column on the portion 15*a* of vapor barrier extending down the front face of the dike section. FIG. 3B2 illustrates an alternate configuration in which the portion 15*d* of vapor barrier extending up the rear face is not routed through the interior between one or more of the tubes 10 within the interior of the dike section 300*b*. In this example, the one or more stakes and/or ground anchors and weight of the tubes 10 on the portion 15*b* of the vapor barrier extending under the dike section 300*b* resist the pulling action of the downward force on the portion 15*a* of vapor barrier extending down the front face of the dike section. The configuration illustrated in FIG. 3B2 may be simpler to implement when the weight of the tubes and/or stakes and anchors provide sufficient strength to resist the putting action.

FIG. 3C1 and FIG. 3C2 are diagrams illustrating a vapor barrier 15 configuration in constructing a diversion dike section according to example embodiments. Specifically, FIG. 3C1 and FIG. 3C2 illustrate additional benefits of diversion dike construction similar to that illustrated in FIGS. 3B1 and 3B2 when the contained fluid seeps under and/or through the portion 15*a* of vapor barrier at the front face of a dike section and/or the portion 15*c* of the vapor barrier extending within the containment area.

As shown in FIG. 3C1, a seepage gap 33 may exist between the portion 15*b* of the vapor barrier extending from the front base of the dike section 300*c* under tube 10*c* to the rear base and the portions 15*a*, 15*c* of the vapor barrier extending down the front face to the front base and into the containment area. As the level 35*a* of the contained fluid 32 rises within the containment area, contained fluid may seep into the ground 101 beyond the portion 15*c* of vapor barrier extending into the containment area. In turn, the contained fluid may seep up from the ground 101 through the gap 33 and into the interior 34 of the vapor barrier wrapping the tubes 10. Additionally, the contained fluid may seep into the interior 34 at overlapping sections of vapor barrier 15 along the dike section 300*c* or via punctures that may occur in the extended portion 15*c* of the vapor barrier in the containment area and/or portion 15*a* of the vapor barrier extending down the front face.

As long as the portion 15*b* of the vapor barrier extending underneath the dike section 300*c* remains secured and portion 15*b* and portion 15*d* of the vapor barrier remain relatively puncture free (i.e., the punctures do not allow escape of fluid faster than the rate of seepage into the interior 34 of the dike section), the seeping fluid is substantially contained within the interior of the dike section by the vapor barrier 15. In turn, a level 35*b* of the seeping fluid within the interior 34 of the dike section 300*c* may rise to a level substantially similar to the surface level 35*a* of the contained fluid.

The seepage of contained fluid 32 from the containment area into the interior 34 of the dike section 300*c* may at first appear as a failure of the dike section 300*c*, however, this is not the case when the vapor barrier 15 sufficiently retains the seeping fluid within the interior 34. In fact, some unexpected benefits are gained in such instances. As the level 35*b* of the fluid within the interior 34 of the dike section 300*c* rises, it counteracts the hydrostatic pressure on the front face of the dike section due to the level 35*a* of contained fluid within the containment area. Specifically, while the contained fluid 32 within the containment area generates a lateral force (which can shift the whole dike section) acting on the front face of the dike section 300*c*, so does the fluid within the interior 34 of the dike section, but in the opposite direction. In fact, when the level 35*b* of fluid within the interior 34 is substantially equal to the level 35*a* of contained fluid 32 within the containment area, the lateral force pushing the portion 15*a* of the vapor barrier away from the front face (e.g., out into the containment area) from within the interior due to the level of fluid within the interior substantially cancels out the lateral force pushing the portion 15*a* of the vapor barrier into the front face due to the level of fluid within the containment area. Accordingly, when the fluid level 35*b* within the dike section 300*c* rises, because the force of the contained fluid 32 on the front face of the dike section is reduced the dike section is less likely to shift.

Although the force against the front face of the dike section 300*c* due to the hydrostatic pressure of the contained fluid 32 may be mitigated when a fluid level 35*b* within the interior 34 of the dike section rises, the fluid within the interior generates a lateral force acting outward from the interior of the dike section on the portion 15*d* of the vapor barrier at the back face of the dike section. For this reason, embodiments of the vapor barrier 15 may include webbing for reinforcement to increase durability. The vapor barrier 15 and securing straps (not shown) around the dike section 300*c* resist this hydrostatic force due to the level 35*b* of fluid within the interior. Importantly, the force on portion 15*b* of the vapor barrier from within the interior 34 of the dike section 300*c* due to the hydrostatic pressure of the fluid level 35*b* does not act to shift the dike section. Weaving the vapor barrier 15 around one or more tubes 10 within the interior 34 (e.g., as shown in FIG. 3B1) aids in resisting the hydrostatic force from the interior 34 fluid level 35*b* and thus may reduce the possibility of the vapor barrier 15 from shifting due to the hydrostatic pressure from the fluid within the interior 34. For example, in embodiments where the vapor barrier 15 routed between one or more of the tubes 10 within the interior of the dike section (e.g., as shown in FIG. 3B1), increasing the level 35*b* of fluid within the interior 34 of the dike section may cause a column of water to form on top of one or more portions of the vapor barrier (e.g., the portion below tube 10*f*) within the interior, which provides downward pressure due to the weight of the column of fluid (e.g., similar to the downward force on the front face of the dike section). This downward pressure on the vapor barrier 15 routed within the interior presses the vapor barrier down against lower level tubes which mitigates shifting of the vapor barrier, tubes 10, and the dike section 300*c* itself when seepage occurs.

As the fluid level 35*b* within the interior 34 rises, portion 15*d* of the vapor barrier may bulge out due to the hydrostatic force acting outwards. Additionally, the weight of the column of fluid within the interior 34 exerts a force acting down on the bulged areas and portion 15*b* of the vapor barrier. The combination of downward force and the bulging act to seal the portions 15*d*, 15*b* of the vapor barrier against the ground 101 at the rear face of the dike section 300*c*, beneficially aiding in preventing fluid from breaching the dike section. FIG. 3C2 illustrates the above principles in practice.

FIG. 3C2 illustrates a 2-1 pyramid dike section 300*d* constructed according to the principles described in connection with FIG. 3C1. As shown, the dike section 300*d* contains a fluid 32 within the containment area and a vapor barrier 15 wrapped around the dike section. The vapor barrier 15 includes a portion 15*b* extending from the front of the dike section 300*d* underneath tube 10*x* and then underneath tube 10*y* to the rear of the dike section 300*d*. Portion 15*b* of the vapor barrier continues to portion 15*d* of the vapor barrier, which wraps around tube 10*y* at the rear of the dike section 300*d* to tube 10*z* at the top of the dike section and continues to portion 15*a* of the vapor barrier. Portion 15*a* of the vapor barrier extends from the top to the dike section 300*d* down the front face, and may include an extend portion (now shown) that extends along the ground 101 into the containment area.

Stake 17*a* secures anchor 3*a* to the ground 101 with strap 13*a* coupled to the anchor and wrapping around the tubes to secure the dike section 300*d* to the ground at the rear. The strap 13*a* may wrap around the vapor barrier 15 and tubes 10 from the rear of the dike section 300*d* to an anchor and/or stake (not shown) at the front of the dike section in order to additionally secure the dike section to the ground. Additional anchors, stakes, and straps may be implemented along the length of rear of the dike section 300*d* at a given interval along will corresponding anchors and stakes at the front of the dike section (not shown). For example, anchor 3*b*, stake 17*b*, and strap 13*b* may secure the dike section 300*d* at an interval 10 feet or greater from anchor 3*a*. Anchor 3*c*, stake 17*c*, and strap 13*c* may secure the dike section 300*d* at the same interval, e.g., 10 feet. Thus, in the present example, securing a 30+ foot length of dike section 300*d* to contain fluid 32 within the containment area. The interval at which anchors, stakes, and straps are positioned may vary based on the height of the dike section 300*d*, composition of the ground, and whether the contained fluid may produce waves acting on the dike section.

As shown, fluid 32 from the containment area has seeped into the interior 34 of the dike section 300*d* to level 35*b*, which may be substantially similar to the level 35*a* of fluid in the containment area. Accordingly, the portion 15*d* of the vapor barrier at the rear of the dike section 300*d* bulges 37 out due to the force of the hydrostatic pressure of the level 35*b* of fluid within the interior 34 acting outwards from within the interior 34 of the dike section 300*d*. Downward force due to the column of fluid within the interior 34 presses the bottom of bulges 37 in portion 15*d* of the vapor barrier against the ground 101, which aids in mitigating seepage of fluid through and underneath the rear of the dike section 300*d* from both the interior 34 of the dike section and the containment area.

Figure 4A:
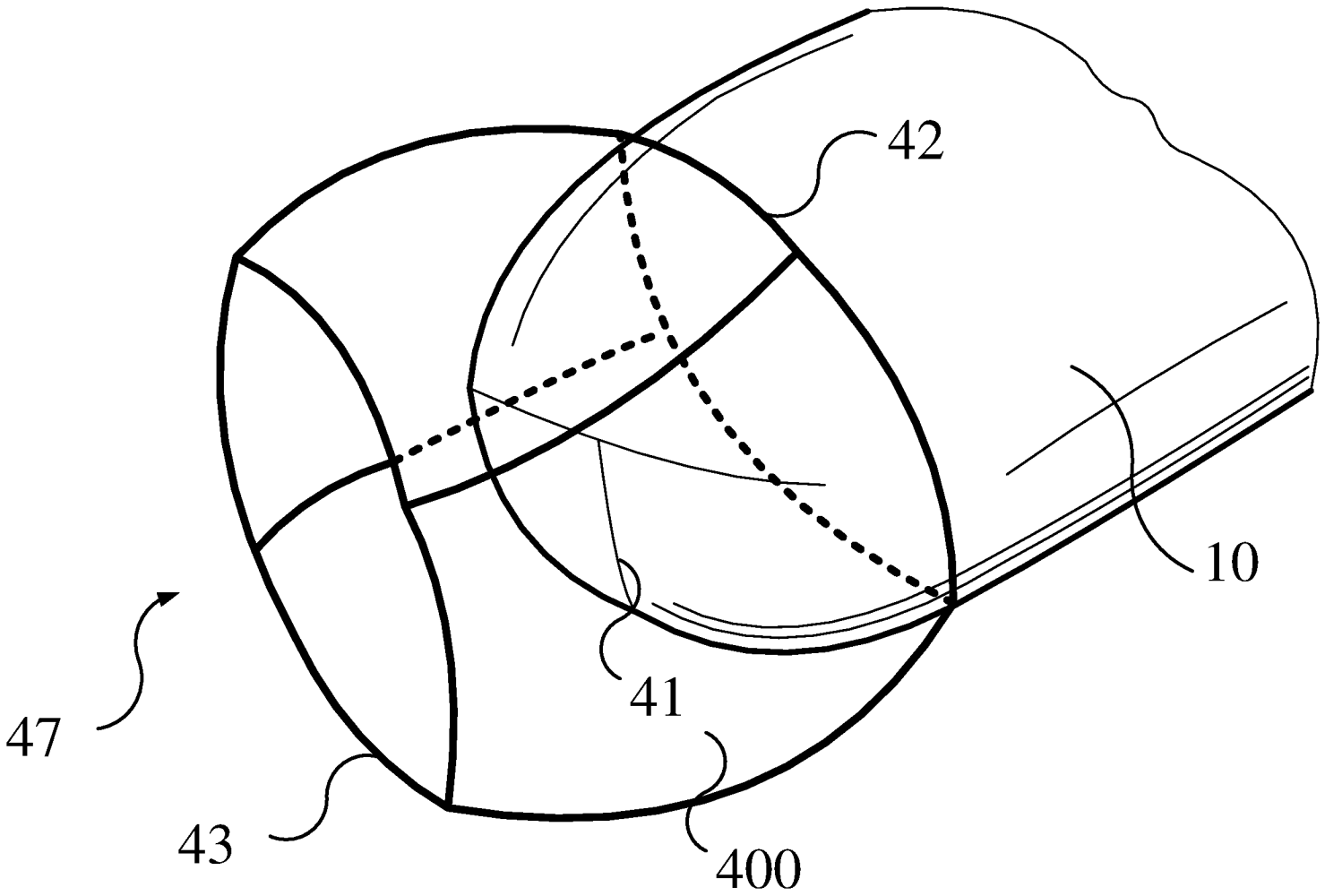
FIG. 4A, FIG. 4B, FIG. 4C are diagrams illustrating an integrated vapor barrier of a flexible containment tube according to example embodiments.
Figure 4B:
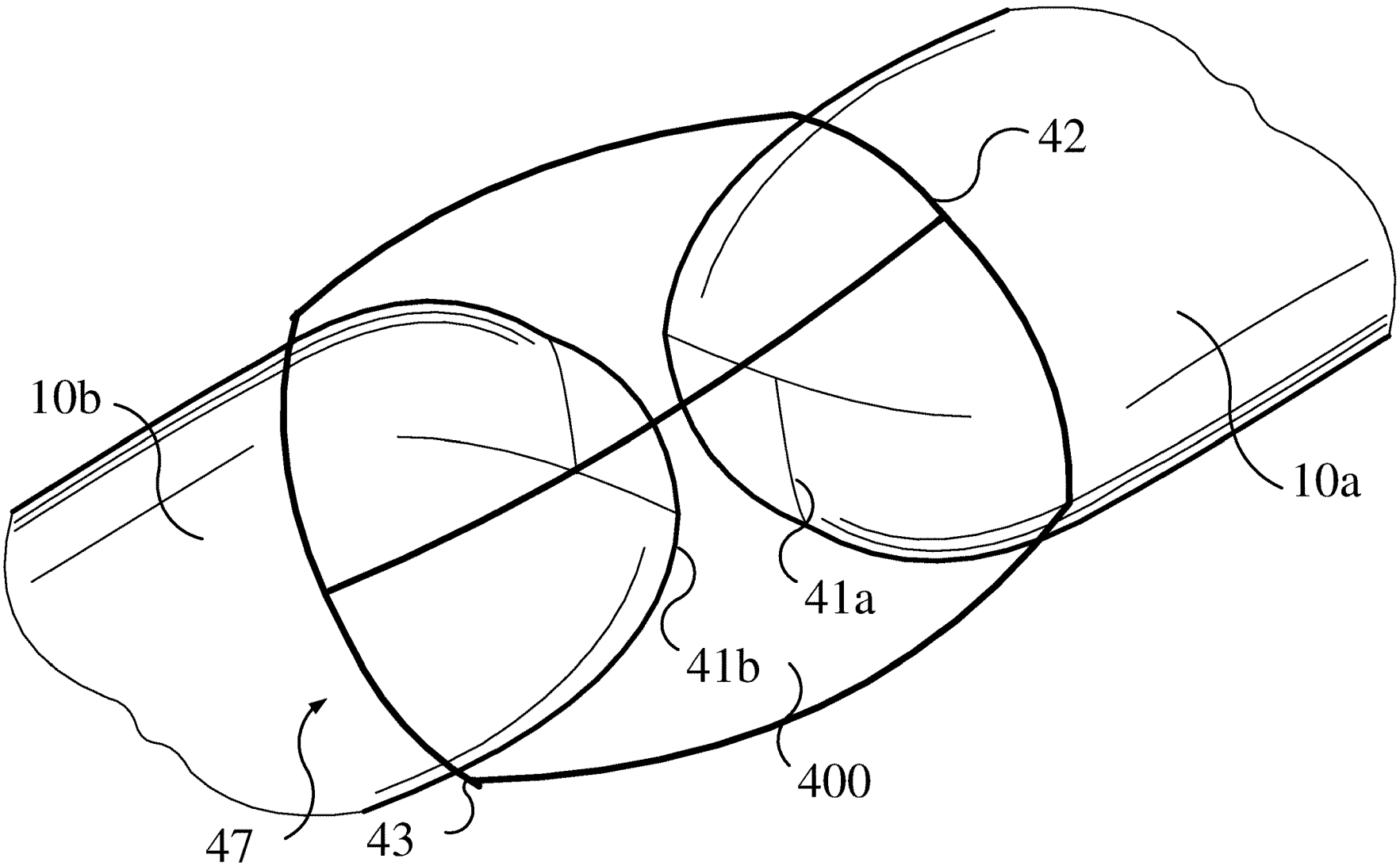
Figure 4C:
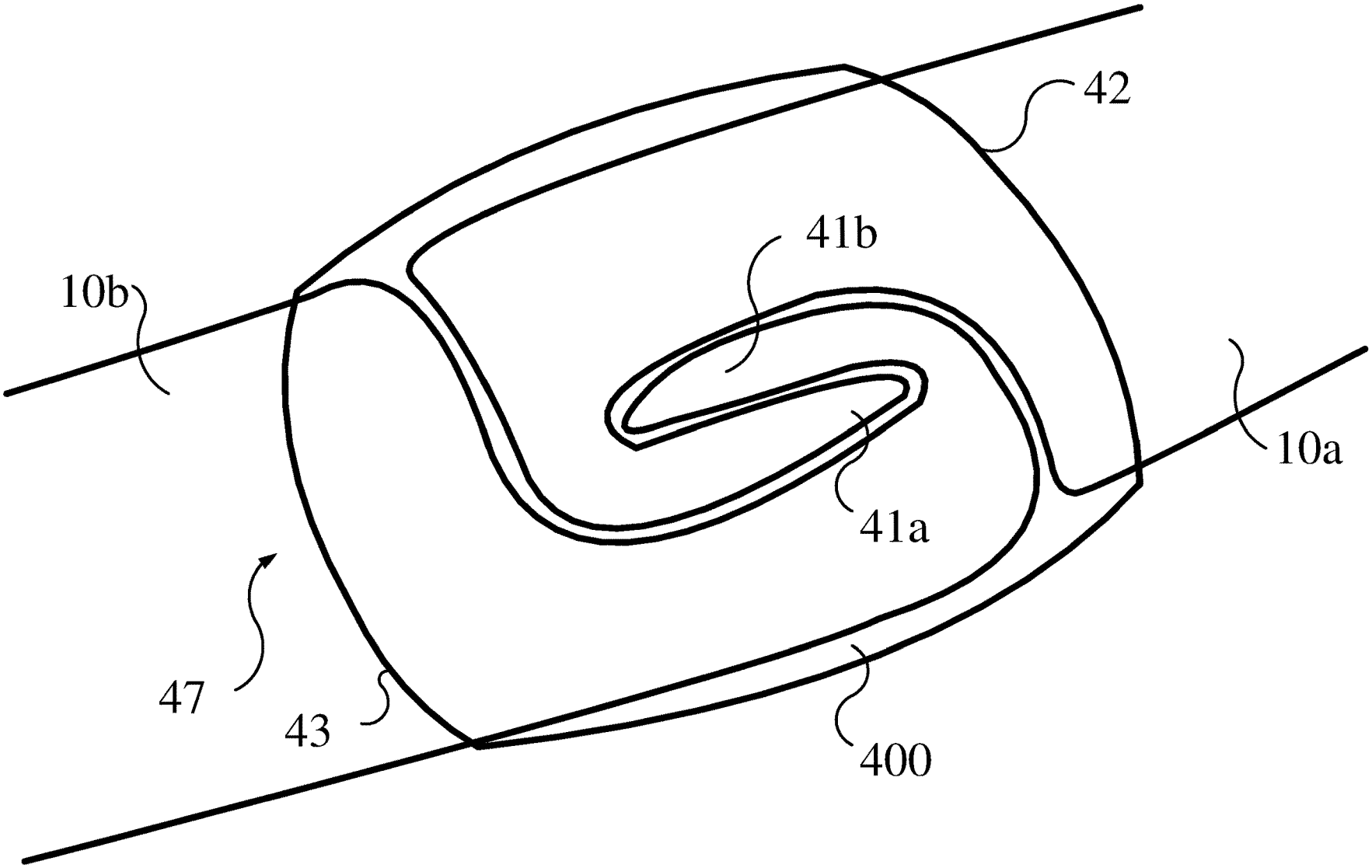

FIG. 4A, FIG. 4B, and FIG. 4C are diagrams illustrating an integrated vapor barrier 400 of a flexible containment tube 10 according to example embodiments. As shown in FIG. 4A, a tube 10 comprises an integrated vapor barrier 400 disposed proximate to an end 41 of is flexible body. Straps, anchors, and/or additional vapor barrier as described previously may work in conjunction with the integrated vapor barriers to hold abutting tubes together to form dike sections from abutted tubes of any length.

The integrated vapor barrier 400 may be attached to the body of the tube 10. For example, end 42 of the integrated vapor barrier 400 may be attached to the body of the tube 10 via a heat mold or other affixing means. In some embodiments, the integrated vapor barrier 400 is a sleeve that extends a distance over the end 41 of the tube 10. In one embodiment, the distance the integrated vapor barrier 400 extends over the end 41 of the tube 10 is sufficient for the end 42 of the integrated vapor barrier to engage the body of the tube 10. In turn, when the tube 10 is filled, the body of the tube expands and is affixed with the end 42 of the integrated vapor barrier 400 via compressing the body of the expanding tube at the end 42. In such cases, end 42 of integrated vapor barrier 400 may be of a diameter less than the diameter of the body of a filled tube 10 to attach via compression. In either instance, with one end 42 of the integrated vapor barrier 400 attached to the tube 10, the opposite end 43 includes an opening 47 and extends a distance past the end 41 of the tube 10 to receive an additional tube.

In one embodiment, the distance the opposite end 43 extends past the end 41 of the tube 10 is sufficient to engage the body of the additional tube, which when filled forms an attachment with the opposite end 43 via compression. Thus, for example, the opposite end 43 of the vapor barrier 400 may be configured similar to end 42 in a sleeve configuration. As an example, the sleeve may span 1-3 feet of the body of the tube 10, and include 1-3 feet of remaining length from the opening 47 to engage the body of another tube inserted in the opening 47. Thus, the integrated vapor barrier 400 may have an overall length of approximately 2-6 feet.

In one embodiment, the integrated vapor barrier 400 is constructed of a watertight material, such as poly visqueen, rubber, etc. or other material similar to that used to construct the tube 10 or vapor barrier 15, to prevent intrusion of fluid through its surface. Thus, for example, when an additional tube is inserted into the opening 47 as illustrated in FIG. 4B, fluid intrusion between abutting tube ends 41*a*, 41*b* may be mitigated. Inclusion of straps, loops and/or anchors, such as those shown in FIG. 1, that prevent shifting of tubes with respect to ground, aid in maintaining engagement of the tubes within the integrated vapor barrier 400 such that a seamless dike may be constructed in any length from multiple dike sections. Additionally, vapor barriers, such as those explained with reference to FIGS. 2-3, may be utilized to wrap pyramid dike sections and especially the junction of two dike sections having abutting tubes attached via integrated vapor barriers 400 to further mitigate fluid seepage through the dike.

As shown in FIG. 4B, a tube 10*a* comprises an integrated vapor barrier 400 disposed proximate to the end 41*a* of is flexible body. The integrated vapor barrier 400 may be attached to the body of the tube 10*a* at one end 42 via a heat mold or other affixing means. In some embodiments, the integrated vapor barrier 400 is a sleeve that extends a distance over the end 41*a* of the tube 10*a* and forms an attachment at end 42 via compression when tube 10*a* is filled.

Also shown in FIG. 4B is the end 41*b* tube 10*b* inserted into the opening 47 of the opposite end 43 of the vapor barrier 400. In one embodiment, the end 41*b* of tube 10*b* is inserted into the opening 47 prior to the filling of tube 10*b*. In turn, when the tube 10*b* is filled, the body of the tube 10*b* expands to form an attachment with end 43 of the vapor barrier 400 via compression. Accordingly, when the integrated vapor barrier 400 is constructed from a watertight material, fluid intrusion between abutting tube ends 41*a*, 41*b* may be mitigated.

As shown in FIG. 4C, a tube 10*a* comprises an integrated vapor barrier 400 disposed proximate to the end 41*a* of is flexible body. The integrated vapor barrier 400 may be attached to the body of the tube 10*a* at one end 42 via a heat mold or other affixing means. In some embodiments, the integrated vapor barrier 400 is a sleeve that extends a distance over the end 41*a* of the tube 10*a* and forms an attachment at end 42 via compression when tube 10*a* is filled.

Also shown in FIG. 4C is the end 41*b* tube 10*b* inserted into the opening 47 of the opposite end 43 of the integrated vapor barrier 400. In one embodiment, the end 41*b* of tube 10*b* is interlocked with the end 41*a* of tube 10*a* within the integrated vapor barrier 400. For example, the tube 10 ends 41 may be rolled together and the integrated vapor barrier 400 extended over the interlocked tube 10 ends to insert tube 10*b* into the opening 47 prior to the filling of the tubes 10.

In turn, when the tubes 10 are filled, the bodies of the tubes 10 expand within the integrated vapor barrier 400 to form an attachment at end 43 (and at end 42 in a sleeve configuration) of the integrated vapor barrier via compression. Additionally, the interlocked tube ends 41 expand against each other within the vapor barrier 400 when the tubes 10 are filled, which securely joins the two tubes together as they are compressed within the walls of the integrated vapor barrier. Accordingly, when the vapor barrier 400 is constructed from a watertight material, fluid intrusion between abutting tube ends 41*a*, 41*b* may be mitigated and the interlocking of the abutting tube ends 41*a*, 41*b* secures the tubes 10*a*, 10*b* from being pulled apart.

Figure 5:
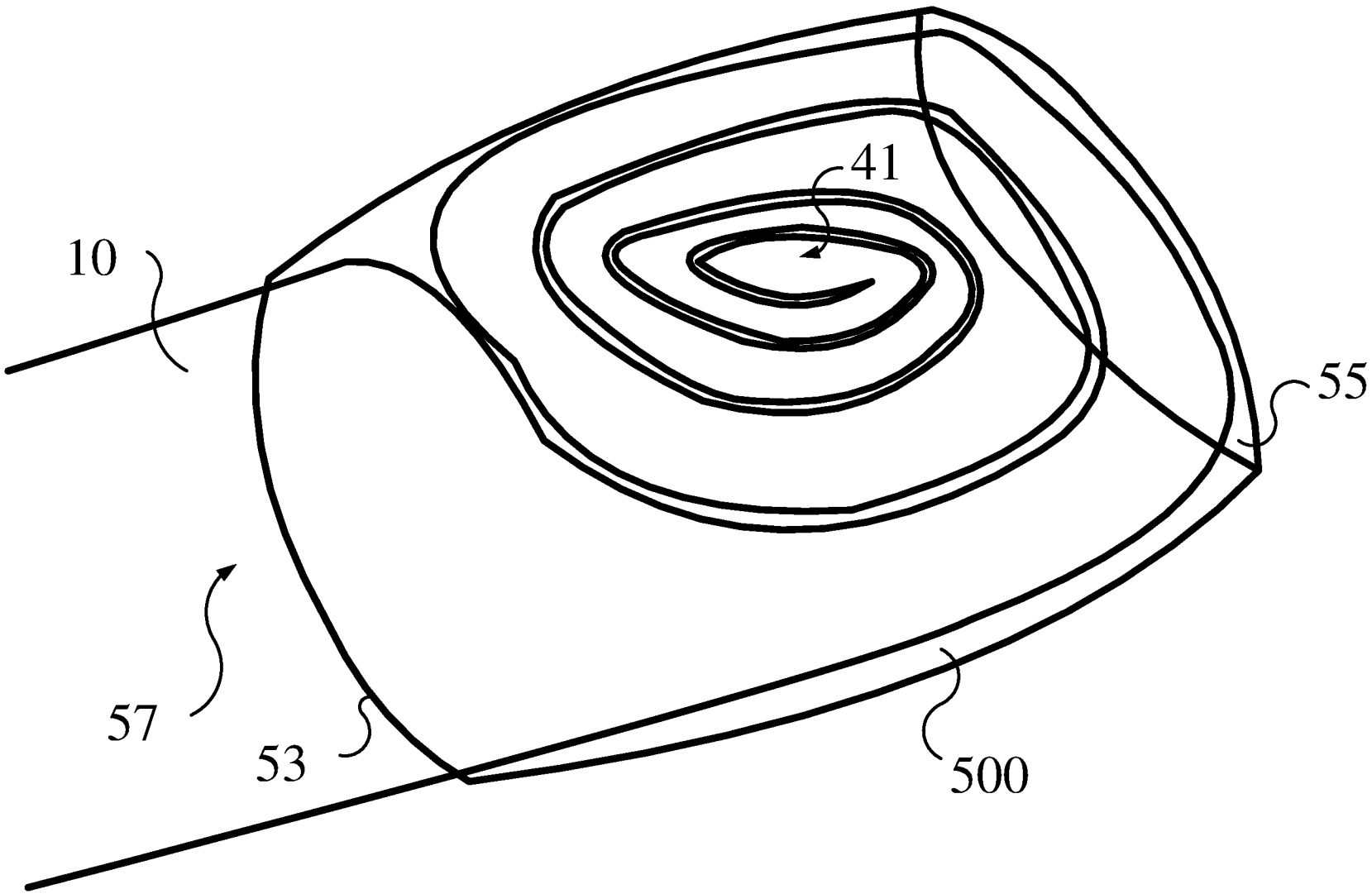
FIG. 5 is a diagram illustrating a sleeve end for a flexible containment tube according to an example embodiment.

FIG. 5 is a diagram illustrating a sleeve end 500 according to an example embodiment. As shown in FIG. 5, a tube 10 according to one embodiment is inserted into a sleeve end 500. The sleeve end 500 includes an opening 57 at one end 53 to receive the tube 10 and is enclosed at the other end 55. The opening 57 of the sleeve end 500 extends a distance (e.g., 1-3 feet) over the end 41 of the tube 10 to form an attachment at end 53 with the body of the tube 10 via compression when tube 10 is filled. The end 41 of the tube 10 may be rolled prior to insertion into the sleeve end 500 to decrease the length of the flexible body extending from the opening 57, and thus reduce the length of a given tube 10 to a shorter length as desired.

The rolled end 41 tube 10 is inserted into the opening 57 of the sleeve end 500 prior to the filling of tube 10. In turn, when the tube 10 is filled, the body of the tube 10 expands within the sleeve end 500 to form an attachment with end 53 of the sleeve end 500 via compression to prevent the tube from expanding to its full length. In such a way, a shorter length of tube may be configured from a longer length of tube. Additionally, the tube 10 may be abutted to another tube at end 55 of the sleeve.

In one embodiment, the sleeve end 500 is a watertight material, such as poly visqueen, rubber, etc. or other material similar to that used to construct the tube 10 of vapor battier 15, to prevent intrusion of fluid through its surface.

Figure 6A:
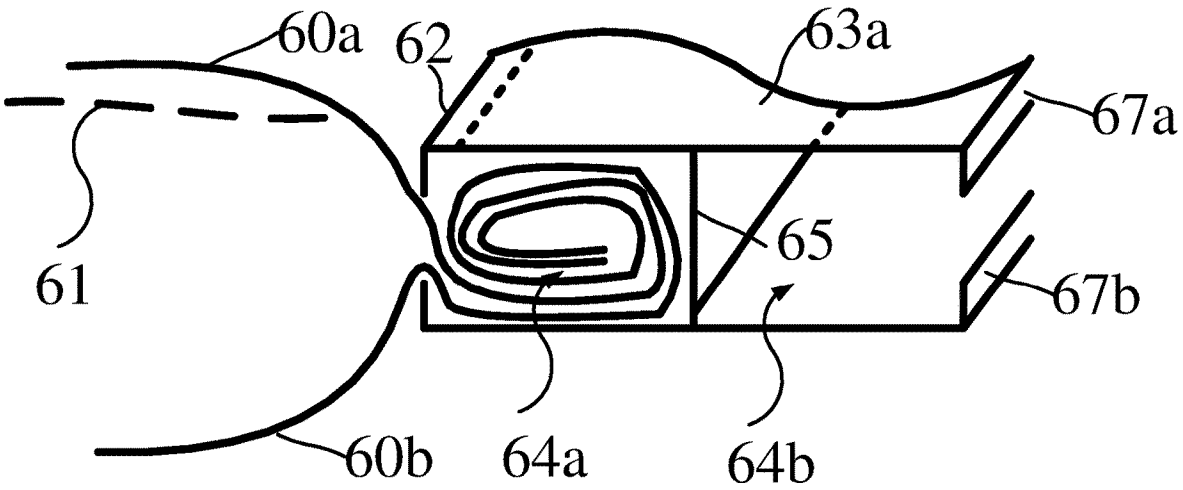
FIG. 6A and FIG. 6B are diagrams illustrating flexible containment tube connectors according to example embodiments.
Figure 6B:
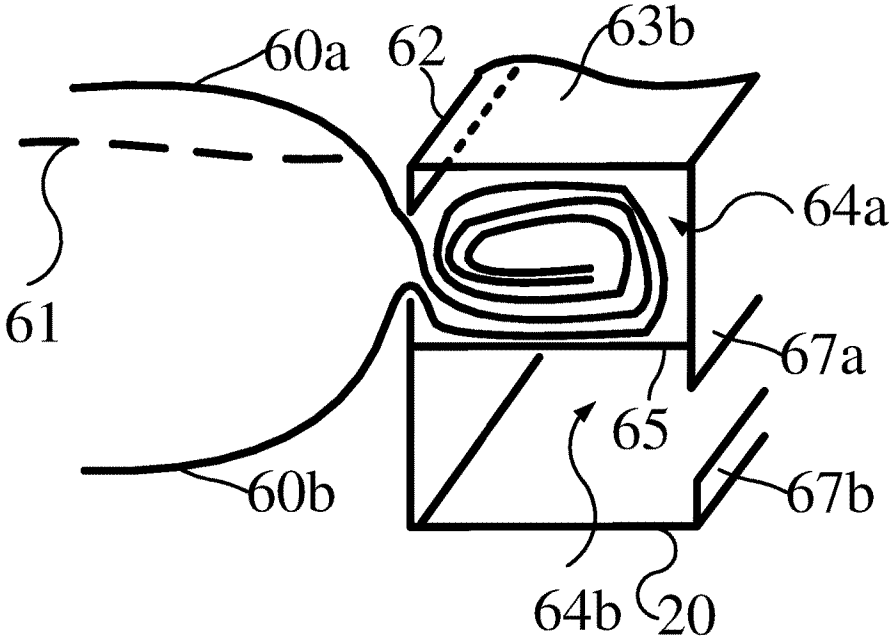

FIG. 6A and FIG. 6B are diagrams illustrating flexible containment tube connectors 63 according to example embodiments. FIG. 6A illustrates a linear tube connector 63*a* according to one embodiment. In one embodiment, a flexible containment tube is not sealed at one or more of its ends. In such embodiments, a connector may seal the end of the flexible containment tube, and optionally couple multiple flexible containment tubes. As shown in FIG. 6A, a tube includes a top side 60*a* and a bottom side 60*b* that are not sealed at the end of the tube. Instead, connector 63*a* secures the end of the tube to form a seal between the top side 60*a* and the bottom side 60*b* of the tube at its end such that fluid 61 may be contained within the flexible body.

In one embodiment, the connector 63*a* includes a first cavity 64*a* to receive a portion of the end of the tube. The portion may be formed by rolling the end of the tube such that the top side 60*a* of the tube is rolled with the bottom side 60*b* of the tube. The rolled end of the tube may then be inserted into the first cavity 64*a*. The length of the connector 63 and thus the first cavity 64*a* may extend a distance similar the diameter of the tube (e.g., up to the width of the top side 60*a* and the bottom side 60*b* of the tube when unfilled) such that rolled end of the tube may be wholly or mostly enclosed within the first cavity 64*a*.

A second cavity 64*b* is shown for ease of explanation and includes features similar to the first cavity 64*a*. The second cavity 64*b* may also receive a rolled end of a tube in a way similar to that of the first cavity 64*a* as explained above. The cavities 64*a*, 64*b* may be separated by an inner wall 65 of the connector 63. In embodiments where only a single cavity (e.g., first cavity 64*a*) is needed, the inner wall 65 of the connector 65 may remain to maintain the first cavity 64*a*. As shown, a cavity 64, and specifically referring to second cavity 64*b* as a reference, includes an upper retaining lip 67*a* and a lower retaining lip 67*b*. Other embodiments may include only a single retaining lip 67 per cavity 64. A retaining lip 67 secures the rolled end of a tube within a cavity 64 to prevent removal of the rolled end when pulled upon in a direction away from the connector 63. Further, when the tube is filled, a side 60 of the tube expands against a retaining lip 67 and the rolled portion expands within the cavity 64 against the retaining lip 67 and walls (e.g., 65) within the cavity to prevent the rolled end of the tube from being removed, and thus also sealing the end of the tube within the cavity 64 to prevent the release of fluid 61 within the tube.

FIG. 6B illustrates a stacked tube connector 63*b* according to one embodiment. The stacked tube connector 63*b* differs from the linear tube connector 63*a* of FIG. 6A in that the space between the tube ends connected via the stacked tube connector 63*b* is reduced. Thus, for example, tube connector 63*b* may mitigate the use of a vapor barrier and/or amount of vapor barrier material used between connected tube ends.

FIG. 7A through FIG. 7E are diagrams illustrating flexible containment tube abutments according to example embodiments. In one embodiment, flexible containment tube ends are formed in different shapes to mitigate seepage of fluid between abutting tube ends. The abutments may be solid or flexible and constructed from, for example, materials such as PCV, molded plastic, metals, etc.

As shown in FIG. 7A1, tube 70*a* is constructed with a slanted tube end 71*a*. Slanted tube ends 71*a* may be at a substantially 45 degree angle such that either a right angle corner or straight section may be formed between two tubes having a configuration of tube 70*a* by abutting two slanted tube ends 71*a* together. Tubes may be configured with other angles as desired.

As shown in FIG. 7B1, tube 70*b* is constructed with a flat tube end 73*a*. Flat tube ends 73*a* may be abutted at their face to form a straight section from two tubes. Alternatively, a flat tube end 73*a* may be abutted against a body of another tube to form a right angle or against a slanted face, such as the 45 degree slant end 71*a* shown in FIG. 7A1 to extend at an angle.

As shown in FIG. 7B2, a tube abutment 72*b* includes a cavity for inserting a flexible containment tube 10 with a round end (or other shaped end). In this way, tubes 10 themselves need not be constructed with a particular shaped end. When filled, the tube 10 may expand against the walls of the cavity of the tube abutment 72*b*. In one embodiment, the cavity is shaped 74 to conform to the round end of the tube 10. Other embodiments of a tube abutment 72*b* may include a cavity shaped 74 to conform to other tube end types such as 71*a*, and 73*b*, of FIG. 7A1 and FIG. 7B1, respectively.

An end 73*b* of the tube abutment 72*b* may be configured in a variety of ways to abut to another tube or tube abutment. For example, FIG. 7B2 illustrates tube abutment 72*b* with a flat end 73*b* that enables abutment in configurations similar to that of the tube 70*b* in FIG. 7B1 constructed with a flat tube end 73*a*.

Referring to FIG. 7A2 as another example, tube abutment 72*a* includes a slanted end 71*b*. The slanted end 71*b* enables abutment in configurations similar to that of the tube 70*a* in FIG. 7A1 constructed with a slanted tube end 71*a*. Additionally, the tube abutment 72*a* may include a cavity for inserting a flexible containment tube 10 with a round end (or other shaped end). Thus, when filled, the tube 10 may expand against the walls of the cavity of the tube abutment 72*a*. In one embodiment, the cavity is shaped 74 to conform to the round end of the tube 10. Other embodiments of a tube abutment 72*a* may include a cavity shaped 74 to conform to other tube end types such as 71*a*, and 73*b*, of FIG. 7A1 and FIG. 7B1, respectively.

FIG. 7C illustrates a two-tube abutment 72*c* for receiving tube 10*a* and tube 10*b*. Accordingly, the two-tube abutment 72*c* may include a cavity shaped 74 to conform to each tube end. In some embodiments, two-tube abutments 72*c* are constructed in other configurations, such with an angle between the two openings. In turn, a corresponding angle is formed between tube 10*a* and tubes 10*b* when the tubes are inserted. In this way, the tubes 10 may be abutted by the two-tube abutment 72*c* to join diversion dike sections in a desired shape.

FIG. 7D illustrates a first tube abutment 72*d*1 configured to receive a first tube 10*a* and including a shaped face to receive a second tube abutment 72*d*2. Similarly, the second tube abutment 72*d*2 is configured to receive a second tube 10*b* and includes a shaped face to receive the first tube abutment 72*d*1. The configuration of the corresponding faces of tube abutments 72*d*1 and 72*d*2 when mated as shown may be such that force against the tubes 10 in one or more directions is resisted to prevent shifting of the tubes when containing or diverting a fluid.

FIG. 7E illustrates a cavity 74 of a tube abutment 72 according to one embodiment. The end 77 of the tube abutment 72 may be configured similar to, for example, abutment end 71*b* in FIG. 7A2, abutment end 73*b* in FIG. 7B2, or in another configuration. As shown, the portion of the tube abutment 72 that extends over the tube end and onto the flexible body of a tube when the tube end is fully inserted to the end shaped 74 portion of the cavity may include a narrowed section 75 at its end. The narrowed section 75 aids in gripping the body of the tube as it expands within the receiving cavity when filled to prevent removal of the tube from the tube abutment 72.

Figure 8A:
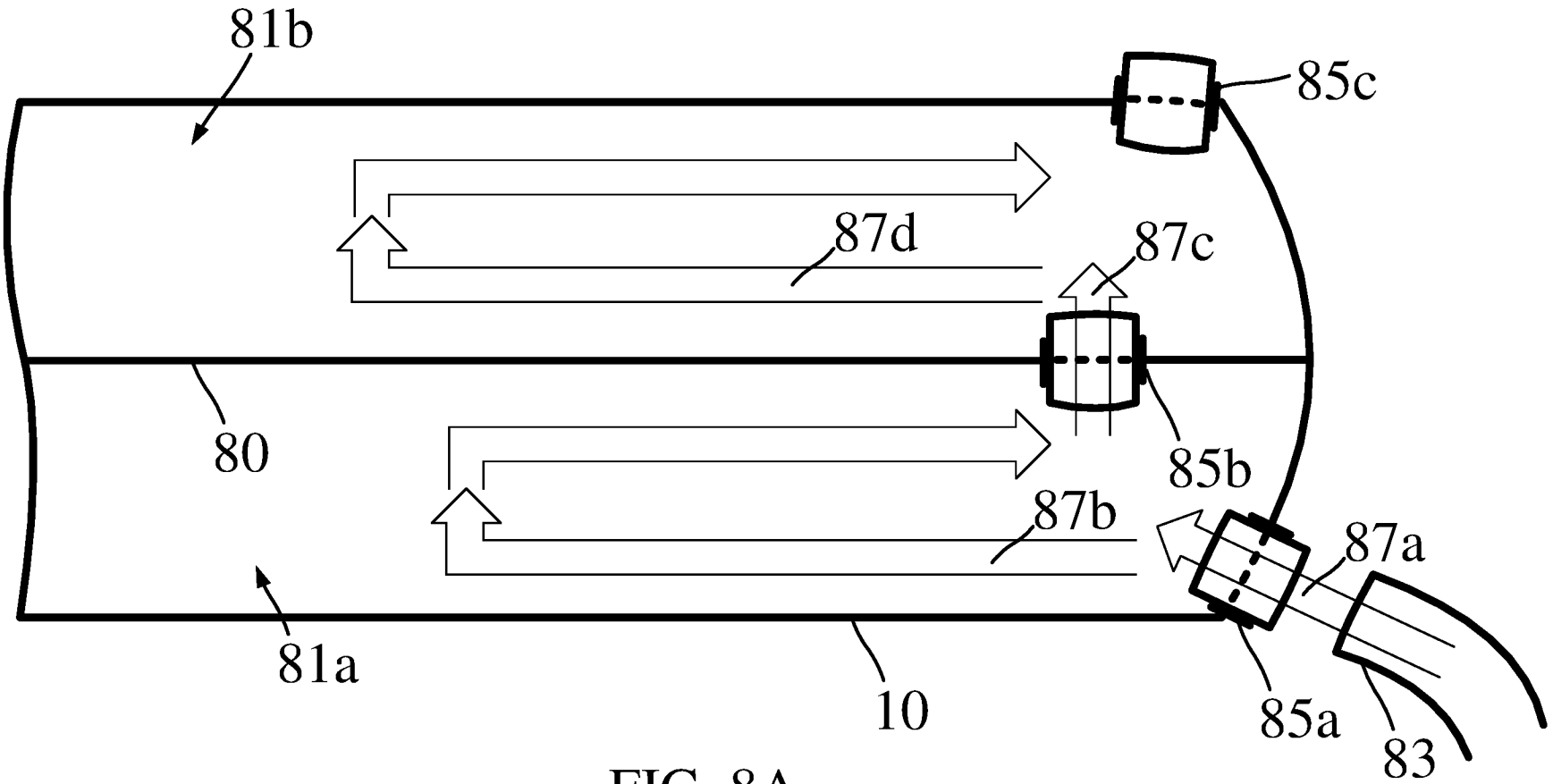
FIG. 8A, FIG. 8B, and FIG. 8C are diagrams illustrating a valve system of a flexible containment tube according to an example embodiment.
Figure 8B:
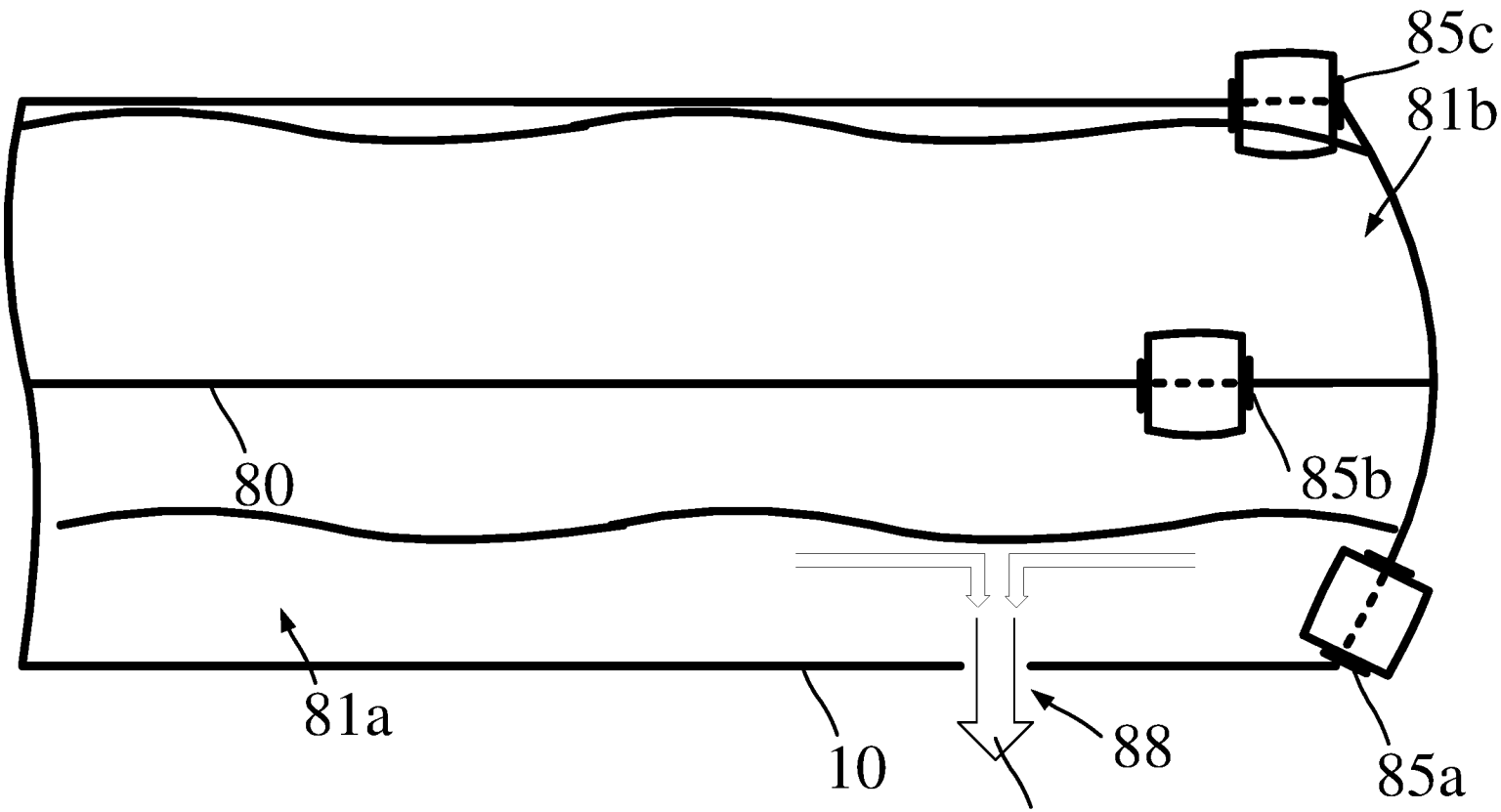
Figure 8C:
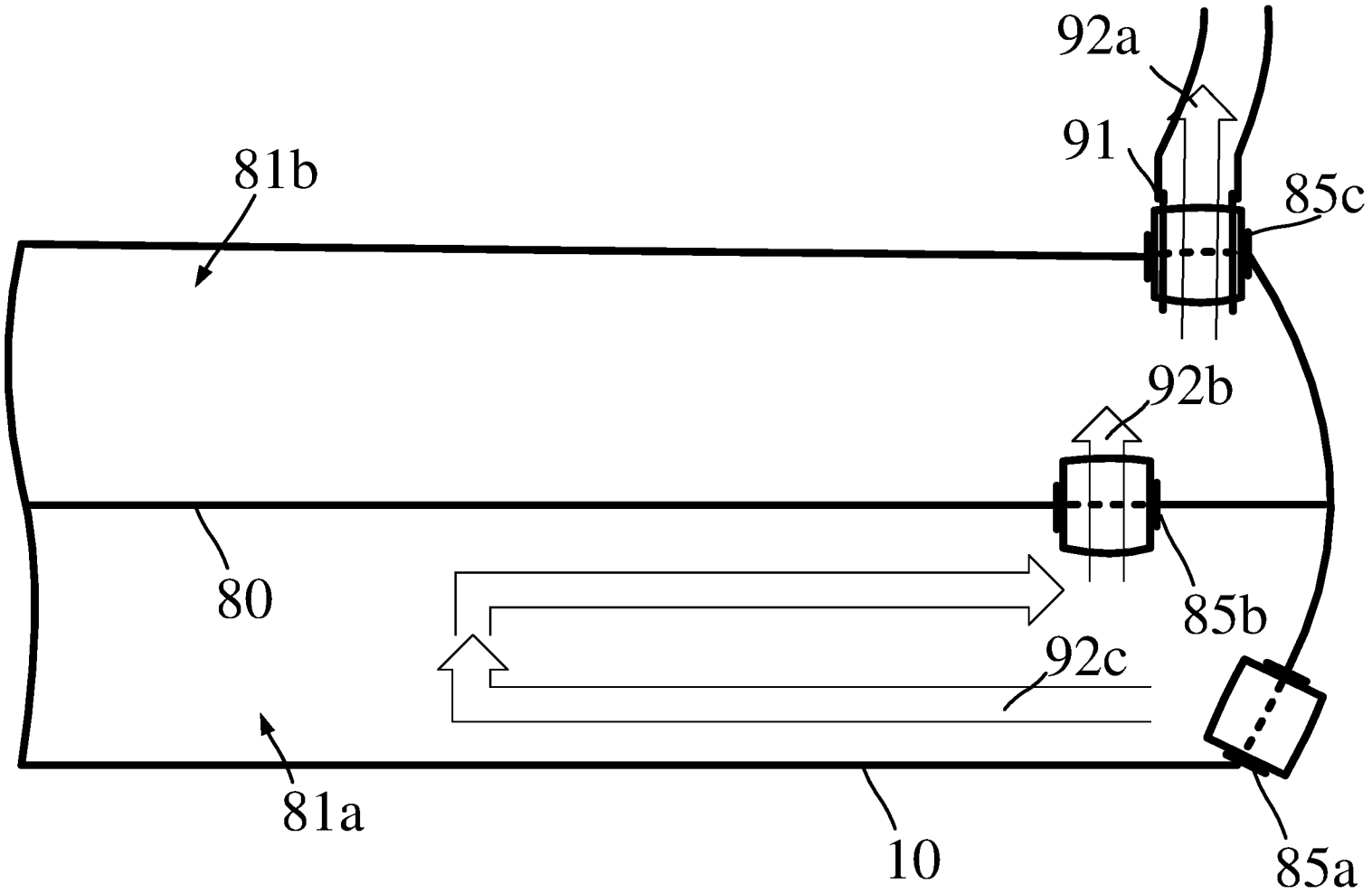

FIG. 8A through FIG. 8C are diagrams illustrating a valve system of a flexible containment tube 10 according to an example embodiment. In one embodiment, the tubes 10 described herein utilize airtight check valves 85 that enable a tube to be pressurized and filled to its maximum capacity. The check valve 85 also enables filling of tubes from the base of an incline in order to force fluids uphill in situations with uneven terrain.

FIG. 8A is a diagram illustrating an example tube configuration for filling a flexible containment tube 10 with a valve system, according to one embodiment. As shown, tube 10 includes an inner membrane 80 forming multiple chambers 81 within a single tube 10. In FIG. 8A, a single inner membrane 80 is shown forming a lower chamber 81*a* and an upper chamber 81*b*. An inner membrane 80 may be formed of a material similar to that of the tube body 10, and as such, may be watertight to separate the fluids in each chamber 81. A valve 85 may be disposed within the membrane 80 to facilitate the flow of fluid from one chamber to the next, but not vice versa. For example, valve 85*b* may facilitate the flow of fluid 87*c* from the lower chamber 81*a* to the upper chamber 81*b* but not from the upper chamber to the lower chamber.

A valve 85*a* disposed in the body of the tube 10 corresponding to the lower chamber 81*a* may receive fluid 87*a* from a connection with a hose 83 or pump, which in turn flows into the lower chamber. The valve 85*a* may prevent the release of fluid from the lower chamber 81*a* when the connection with the hose 83 is terminated.

Fluid 87*a* received via valve 85*a* flows into and fills 87*b* the lower chamber 81*a*. When the fluid filling 87*b* capacity of the lower chamber is eventually reached, valve 85*b* permits the flow of fluid 87*c* from the lower chamber into the upper chamber 81*b*. Thus, receiving additional fluid 87*a* into the lower chamber 81*a* causes the upper chamber 81*b* to fill 87*d* with fluid. Valves 85*a* and 85*b* may also be of similar construction to reduce the number of components required for tube 10 construction. A valve 85*c* disposed in the body of the tube 10 corresponding to the upper chamber 81*b* may permit the release of gas/fluid from the upper chamber 81 to the outside of the tube 10. In some embodiments, valve 85*c* includes a pressure release that activates to release fluid from the upper chamber 81*b* when a maximum fill pressure condition is experienced. Valve 85*c* may also include a release mechanism that is engaged to empty fluid from the tube 10.

FIG. 8B illustrates an example benefit of the valve and tube configuration of FIG. 8A in the event of a puncture 88 or other failure of the tube 10 body corresponding to the lower chamber 81*a*. As shown, the lower chamber 81*a* of a filled tube 10 is punctured and fluid 89 escapes from the lower chamber 81*a* via the puncture. However, because fluid in the upper chamber 81*b* can neither pass through the membrane 80 nor the valve 85*b* into the lower chamber 81*a* it does not escape through the puncture 88. Valves 85*a* and 85*c* also do not release fluid from the upper chamber 81*b*. Hence, the fluid level in the upper chamber 81*b* is maintained to prevent complete failure of the tube 10.

In scenarios where the upper chamber 81*b* is punctured, fluid from both chambers may escape in the example configuration of tube 10. However, because the lower chamber 81*a* is most likely to experience a puncture, such a scenario is less likely.

FIG. 8C illustrates an example of emptying a tube with the valve configuration of FIG. 8A. As shown, a connector 91 attached to a hose engages a release mechanism of valve 85*c* (e.g., opens a pressure release) to release fluid 92*a* from the upper chamber 81*b*. As fluid is released from the upper chamber 81*b*, valve 85*b* allows fluid 92*b* to pass from the lower chamber 81*a* past the membrane 80 to the upper chamber such that fluid 92*c* within the lower chamber 81*a* is also emptied. In some embodiments, the valve 85*c* is of similar configuration to valves 85*a*, 85*b* to reduce manufacturing costs. In such cases, valve 85*c* may be a check valve that does not include a pressure release and the connector 91 when inserted forces open the check valve.

Upon reading this disclosure, those of ordinary skill in the art will appreciate still additional alternative structural and functional designs through the disclosed principles of the embodiments. Thus, while particular embodiments and applications have been illustrated and described, it is to be understood that the embodiments are not limited to the precise construction and components disclosed herein and that various modifications, changes and variations which will be apparent to those skilled in the art may be made in the arrangement, operation and details of the method and apparatus disclosed herein without departing from the spirit and scope as defined in the appended claims.

What is claimed is:

1. An apparatus for containing a fluid within a containment area, the apparatus comprising:

a containment tube on a ground surface configured to receive a filling fluid, wherein an end of the containment tube forms an opening, wherein the end of the containment tube is rolled into a rolled end; and a water-tight vapor sleeve extending over at least the rolled end and an end of a second containment tube, wherein the water-tight vapor sleeve prevents water from entering a cavity, the cavity being an area within the water-tight vapor sleeve and including a space between the rolled end and the end of the second containment tube.

2. The apparatus of claim 1, wherein the water-tight vapor sleeve is affixed to a flexible body of the containment tube.

3. The apparatus of claim 2, wherein the flexible body of the containment tube is comprised of vinyl-coated polyester.

4. The apparatus of claim 1, wherein the water-tight vapor sleeve is comprised of plastic.

5. The apparatus of claim 1, further comprising:

one or more anchors configured to secure the apparatus to the ground surface.

6. The apparatus of claim 1, wherein the filling fluid is in a fluid state.

7. The apparatus of claim 1, wherein the filling fluid is in a gaseous state.

8. The apparatus of claim 1, wherein the water-tight vapor sleeve acts as an end-cap that surrounds the rolled end, the rolled end compressed against the end-cap.

9. The apparatus of claim 1, wherein the rolled end is a first rolled end, and wherein the first rolled end is rolled together with a second rolled end of a second containment tube.

10. The apparatus of claim 9, wherein the water-tight vapor sleeve extends at least over the first rolled end and the second rolled end.

11. The apparatus of claim 1, wherein the containment tube has a first length, and wherein when the end of the containment tube is rolled into the rolled end, the containment tube is shortened from the first length to a second length that is shorter than the first length.

12. The apparatus of claim 11, wherein, when the containment tube is filled with the filling fluid, a body of the containment tube expands within the water-tight vapor sleeve to form an attachment with an end of the water-tight vapor sleeve.

* * * * *